US011091878B2

(12) United States Patent
Noel et al.

(10) Patent No.: US 11,091,878 B2
(45) Date of Patent: Aug. 17, 2021

(54) METHOD FOR PRODUCING PAPER IMPREGNATED BY A SUPERCRITICAL-PRESSURE FLUID, AND IMPREGNATED, PARTICULARLY COLOURED PAPER

(71) Applicants: ARJO WIGGINS FINE PAPERS LIMITED, Aberdeen (GB); COMMISSARIAT À L'ENERGIE ATOMIQUE ET AUX ENERGIES ALTERNATIVES, Paris (FR)

(72) Inventors: Céline Noel, Quaix-en-Chartreuse (FR); Christophe Chartier, Apprieu (FR); Gaël Depres, Chirens (FR); Jean-Marie Vau, Paris (FR); Olivier Poncelet, Grenoble (FR); Aurélien Auger, Grenoble (FR)

(73) Assignees: ARJO WIGGINS FINE PAPERS LIMITED, Aberdeen (GB); COMMISSARIAT À L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 17 days.

(21) Appl. No.: 16/085,794

(22) PCT Filed: Mar. 16, 2017

(86) PCT No.: PCT/FR2017/050607

§ 371 (c)(1),
(2) Date: Sep. 17, 2018

(87) PCT Pub. No.: WO2017/158302

PCT Pub. Date: Sep. 21, 2017

(65) Prior Publication Data

US 2019/0330801 A1 Oct. 31, 2019

(30) Foreign Application Priority Data

Mar. 16, 2016 (FR) ..... 1652246

(51) Int. Cl.
*D21H 17/20* (2006.01)
*D21H 19/22* (2006.01)
(Continued)

(52) U.S. Cl.
CPC ..... *D21H 17/20* (2013.01); *D21H 19/22* (2013.01); *D21H 21/28* (2013.01); *D21H 23/44* (2013.01); *D21H 25/06* (2013.01); *D21H 21/10* (2013.01)

(58) Field of Classification Search
None
See application file for complete search history.

(56) References Cited

U.S. PATENT DOCUMENTS 1,926,614 A 9/1933 Draves et al.
4,042,577 A 8/1977 Kaul
(Continued)

FOREIGN PATENT DOCUMENTS

BE 740009 3/1970
BE 820674 4/1975
(Continued)

OTHER PUBLICATIONS

French Search Report for Application No. 1652246, dated Oct. 6, 2016.
(Continued)

*Primary Examiner* — Dennis R Cordray
(74) *Attorney, Agent, or Firm* — Nixon & Vanderhye

(57) ABSTRACT

In the field of papermaking and more particularly a method for producing paper impregnated with a molecule of interest, particularly colored paper, and the associated product, i.e.
(Continued)

Figure 1:
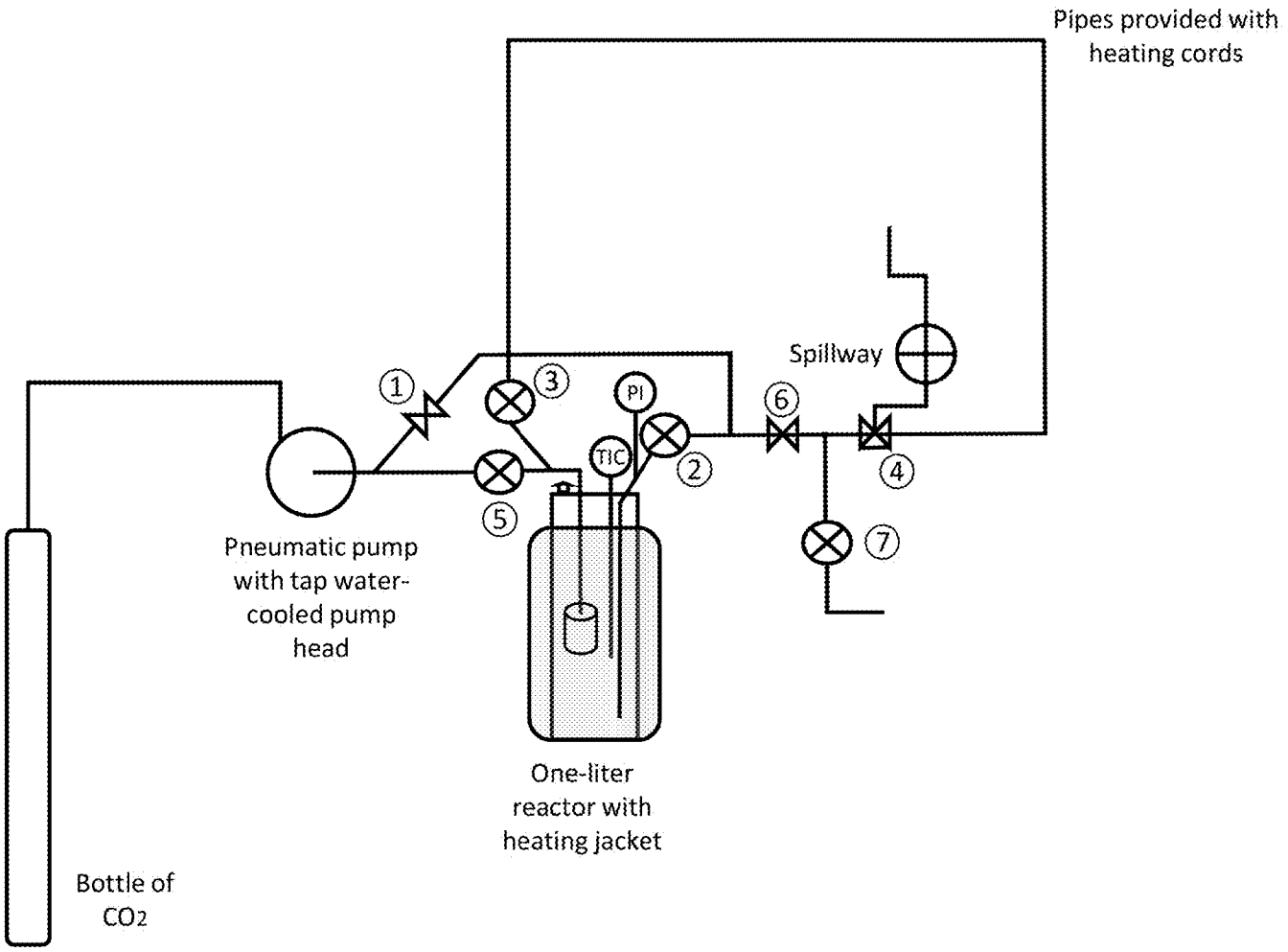

impregnated paper, there is a disclosed a method implementing a supercritical-pressure fluid. Such paper, particularly colored paper, obtained from a formulation of paper pulp or paper including latex, does not bleed when it comes into contact with water.

23 Claims, 2 Drawing Sheets

(51) Int. Cl.

| | |
|---|---|
| ***D21H 21/28*** | (2006.01) |
| ***D21H 23/44*** | (2006.01) |
| ***D21H 25/06*** | (2006.01) |
| *D21H 21/10* | (2006.01) |

(56) References Cited

U.S. PATENT DOCUMENTS

| | | | |
|---|---|---|---|
| 4,289,880 | A | 9/1981 | Moser |
| 4,510,019 | A | 4/1985 | Bartelloni |
| 4,612,251 | A | 9/1986 | Fredenucci et al. |
| 2009/0049625 | A1 | 2/2009 | Miyamoto et al. |
| 2017/0096773 | A1 | 4/2017 | Auger et al. |

FOREIGN PATENT DOCUMENTS

| | | |
|---|---|---|
| BE | 834146 | 4/1976 |
| CA | 2211776 | 4/1998 |
| CH | 635218 | 3/1983 |
| CN | 102877363 | 1/2013 |
| DE | 2123963 | 11/1972 |
| DE | 2138014 | 2/1973 |
| DE | 2805234 | 8/1979 |
| DE | 3041838 | 7/1982 |
| DE | 3044563 | 7/1982 |
| EP | 2876203 | 5/2015 |
| FR | 2020430 | 7/1970 |
| FR | 2795082 | 12/2000 |
| FR | 2916769 | 12/2008 |
| FR | 3015988 | 7/2015 |
| GB | 923429 | 4/1963 |
| GB | 1560929 | 2/1980 |
| IT | 7949811 | 3/1987 |
| WO | 2006-112452 | 10/2006 |
| WO | 2011-146367 | 11/2011 |
| WO | 2014-177586 | 11/2014 |
| WO | 2015-140750 | 9/2015 |

OTHER PUBLICATIONS

International Search Report for Application No. PCT/FR2017/050607, dated May 12, 2017.

Blus et al., "New Eco-friendly Method for Paper Drying," Fibres & Textiles in Eastern Europe 2014; 22, 5(107): 121-125.

METHOD FOR PRODUCING PAPER IMPREGNATED BY A SUPERCRITICAL-PRESSURE FLUID, AND IMPREGNATED, PARTICULARLY COLOURED PAPER

The invention relates to the field of papermaking and more particularly relates to a method for manufacturing a paper impregnated with a molecule of interest, in particular a colored paper as well as the associated product, i.e. an impregnated paper and in particular a colored paper whose color does not bleed when it comes into contact with water, in other words, a paper whose molecules of interest, dyes in particular, are stable in the paper when it comes into contact with water.

The means according to the invention and in particular the paper, in particular the colored paper produced, can be implemented in many fields of application including packaging in general, papers intended for contact with food (wrapping paper, absorbent paper and in particular napkins, tablecloths), papers used in the field of hygiene, wiping, papers intended for outdoor use such as advertising posters, envelopes, and also printing papers, in particular for the fields of communication, advertising, publication, the arts and creative leisure activities, security papers such as banknotes, technical papers in particular intended for scientific use such as membrane filters, papers intended for tests, for example medical tests, labels.

The currently produced colored papers have problems of bleeding dyes when they are wet. This is particularly inconvenient for applications in the field of packaging, in particular in the field of luxury goods, but also in the field of food packaging, the field of absorbent paper, papers intended for hygiene or technical papers.

The principle of papermaking has evolved very little since its invention. Using an aqueous suspension of cellulosic fibres, a sheet is formed on a wire cloth by drainage: this fibrous mat is then pressed and dried in order to remove excess water. The manufacturing of colored paper then involves adding to the fibrous suspension dyes that are soluble or dispersed in water and have a sufficient affinity for the fibers so that a large portion is maintained in the fibrous mat during draining. Fixatives are used most of the time in order to improve the bond between the fibers and the dyes.

Alternatively, colored papers are obtained by coloring the surface of the paper, for example using the size-press. White papers can be treated in the same way with brightener agents.

Adding dyes to the pulp is the most commonly used method for obtaining colored papers. In this case, the dyes are generally added to the pulp, either in the pulper, or in the mixing tank.

According to the fibrous material to be dyed and the intended use of the paper, different types of dyes, such as basic dyes (anionic dyes), direct dyes, or acid dyes, are used. In addition, fixatives and other adjuvants are used in order to improve the dye fixation and obtain better results. Despite this, a substantial quantity of dye is lost in the water circuits.

Such a process generates aqueous polluting discharges which has a detrimental impact on the environment and requires treatment of the effluents.

Moreover, despite the progress made in terms of fixation, these hydrophilic dyes tend to bleed when the paper is wet. The method of manufacturing colored paper further generates a portion of dyes that are simply trapped in the fibrous network. These dyes will bleed much more readily if they have not created chemical bonds with the fibres.

When the surface of the paper is colored in the size-press, the dyes are added to the "size" of the press. The dyeing on the surface is therefore limited to certain particular cases because it is difficult to obtain uniform coloration of the paper. This method, however, has the advantage of eliminating the presence of dyes in the water circuits.

The main impact of the dyeing on the environment is the polluting aqueous discharges in aquatic environments. Usually, paper mills operate by "campaigns" and first produce colored papers with the lighter colors and progressively move to the darker colored paper. However, after the production of the paper with the darker colors, the water circuit must be washed before another manufacturing campaign. The colored waste water must be treated in a complex installation before it can return to the waterways. Furthermore, several times per month, the pipelines are chemically treated to remove deposits and dye residues. Certain plants use elemental chlorine and hypochlorite for this chemical treatment.

Moreover, such methods of dyeing paper by campaigns generate substantial stocks of paper required to render the production phases profitable. As a consequence, paper mills have to produce and store, for each color, and for each type of paper and each grammage, several rolls or reams of each shade thus produced to meet customer needs between two production campaigns.

In that respect, in the 1980s in particular, dyes having an improved resistance to water were proposed [1] [2] [3] [4] [5] [6] [7] [8] [9] [10] [11]. Despite this, these dyes, hydrophilic or dispersed in water, retain a tendency to bleed when the paper comes into contact with water. Contrary to dyeing textile, cotton in particular, which includes a washing step to remove unbound dye molecules, the method of manufacturing colored paper that does not include a step of washing generates a portion of molecules that are simply trapped in the fibrous network. These molecules bleed more easily when in contact with water as they do not have any real point of anchorage on the fibers.

Finally, more recently, an article published in 2014 in the review Fibres & Textiles in Eastern Europe [15] proposed, to overcome the problem of bleeding, a method for dyeing paper based on the use of reactive dyes, i.e. capable of forming covalent bonds with the cellulose fibers. However, reactive dyes are not currently used in the papermaking industry because the reaction parameters are not compatible with the paper-making process. This article describes dyes that can be used at a neutral pH, with almost total retention during a contact time that is compatible with the method and with a specially synthesized retention agent. The paper produced then has good resistance properties to bleeding. This interesting alternative is currently not industrializable as neither the dyes nor the retention agent used are commercial products.

Alternatives to the conventional methods for dyeing paper have also been sought over time in order to improve the quality of dyeing of papers and facilitate industrial production. As such, some ways of development have been proposed targeting the methods of production of colored paper.

In that respect, a patent from 1931 [12] describes a coloration with a calender with an acid dye to which a compound from the guanidine group is added in excess with respect to the theoretical quantity required for the precipitation of the dye in order to improve the non-bleeding nature of the paper. The document [13] also describes a method of post-dyeing: the paper roll is unrolled in order to be soaked in a dye bath; the excess is removed, then the paper is dried. The dye is then fixed by a size-press treatment. The paper is finally dried, calendered and rewound. The document [14] describes a dye composition containing both pigments (<200 nm) and a polymeric binder in the form of particles. This composition makes it possible to form a thin dye layer on the surface of the support, having good properties in terms of color and resistance. These techniques all have the advantage of being economical and ecological. However, they lead to obtaining a non-uniformly colored paper in the thickness of the sheet.

This invention proposes a solution to the problem of the bleeding observed in colored papers when they are brought into contact with water, which makes it possible to use commercially available dyes and calls upon a method of dyeing by impregnation by means of a fluid under supercritical pressure. The method according to the invention uses dyes that can be hydrophobic (referred to as dispersed dyes) which, insofar as they have little or low affinity with water, will be unlikely to migrate in water in contact with it if they are correctly trapped in a hydrophobic polymeric network contained in the fibrous mat of the paper or on the surface of the paper. In the context of the invention, these hydrophobic dye molecules are integrated and fixed in the network of hydrophilic fibres and homogeneously, to the core of the paper and/or on the surface. The invention therefore describes a multi-step manufacturing process that results in an impregnated cellulosic product, in particular an intensely and uniformly colored product whose color does not bleed when it comes into contact with water. A first step of the method consists in manufacturing, on conventional paper machine, a white sheet containing a polymeric additive in bulk and/or on the surface added in the form of latex, and more preferably added in bulk during the manufacture of the paper. This white sheet is then impregnated, in particular colored with hydrophobic dyes, by impregnation by fluid (in particular with $CO_2$) at a supercritical pressure.

The impregnation by supercritical $CO_2$ may also have been mentioned in prior art for dyeing paper, since the technique was known for dyeing polymeric supports such as hydrophobic synthetic textiles. The dyeing of natural fibers such as cotton or cellulose of the paper gives rise to the problems of affinity between the various compounds present (supercritical $CO_2$, hydrophilic fibre and hydrophilic and hydrophobic dyes). Many studies attempt to resolve this technical problem for textiles made of cotton in particular, none of which has at the moment resulted in a sufficiently satisfactory solution to be industrialized.

The coloration of a paper support by means of a supercritical fluid has been the subject of rare studies. The document [16] describes, among other things, the impregnation of paper with hydrophobic dyes via the use of a supercritical fluid. The substrate described in this document is any paper whose constituent elements, substantially fibres of cellulose, do not have any particular affinity for the hydrophobic dye. This results in a low color intensity where the dye is precipitated without any fixation in the fibrous network.

Patent application [17] proposes a method for dyeing cellulose fibers in a supercritical $CO_2$ medium with a hydrophobic and uncharged dye comprising at least one step consisting of putting said fibres in the presence with an effective quantity of at least one primary mono organo-urea in conditions that are suitable for establishing covalent bonds of the carbamate type between the cellulose and the molecules of said organo-urea. This method has several disadvantages. First of all, the reaction between the mono organo-urea and the cellulose involves a gaseous release of $NH_3$ which generates a risk of overpressure in the reactor. In addition, the mechanism proposed generates a modification in the cellulose, of its morphology, as well as a destruction of a portion of the hydrogen bonds of the fibrous network, bonds which ensure the initial mechanical properties of the sheet.

The document [18] relates to the manufacture of a colored paper by supercritical $CO_2$ impregnation following the manufacture of a white sheet containing amphiphilic molecules. As such, the product described in this document does not offer an entirely satisfactory solution to the problem of bleeding as the amphiphilic molecules themselves having a hydrophilic nature will likely to be swept away when in contact with water and carry the dye molecules, although hydrophobic, along with them. In addition, such paper, containing a substantial proportion of surfactant will have a degraded mechanical resistance as well as poor resistance to the penetration of water.

As such, no colored paper by supercritical $CO_2$ impregnation with hydrophobic dyes described to date in the prior art fully meets the requirements in the perspective of industrial production. Although the attempts made have shown that the supercritical fluid impregnation technique offered attractive industrial prospects, the difficulties encountered with regard to the choice of the dyes and the composition of the paper that could be treated by this technique have not been resolved to consider this approach in a satisfactory manner.

Among the paths of research explored concerning the methods of dyeing or the composition of dyes or paper, considering the advantages of the impregnation technique by means of supercritical fluid from an industrial and ecological standpoint, the inventors have taken interest in alternative formulations of the fibrous pulp intended for the manufacture of the paper which improve the quality of the dyeing obtained from the paper by providing a color that is stable when in contact with water and homogeneous at the core and/or at the surface of the paper. Furthermore, the inventors have considered that the conditions thus proposed could also be implemented for the impregnation of paper with other molecules of interest, in particular hydrophobic molecules, when they are soluble in a supercritical-pressure fluid.

The original solution proposed according to the invention consists in impregnating, in particular dyeing, a paper containing a polymeric additive introduced in the form of latex (hereinafter also referred to as "latex") introduced in bulk and/or applied on the surface. Although it is known to use latexes in the paper-making field, it is for the purpose of modifying the properties specific to the produced paper and in particular its mechanical properties, on the one hand, and under conditions that are distinguished from those proposed in the context of the invention, on the other hand. The latexes are thus most often used on the surface of the paper as binders of a pigmented layer, which is deposited by size-press or using a coater which makes it possible to improve various properties such as the appearance (brilliance, whiteness, opacity), the print rendering (contrast, definition of the image), to reduce the surface roughness and porosity or to provide the paper with specific properties such as barrier, insulating properties, etc. They can also be used to chemically consolidate non-woven products. The latexes are then introduced in the support via various techniques: impregnation (size-press or bath), spraying or coating according to the desired result. The action of consolidation is then developed in a dryer or a suitable oven. In contrast, although the addition of latex in the wet portion of the paper machine so that it is uniformly distributed in bulk in the produced paper, i.e. throughout the thickness of the fibrous network, has been the subject of several studies, it has remained limited to the manufacturing phase of the paper sheet.

By way of examples, documents [19] and [20] both relate to a procedure for adding latex in the bulk of the paper and its retention by cationic flocculation agents in order to improve the mechanical resistance properties of the product obtained. The document [21] relates to a fibrous substrate (containing at least 50% cellulose) saturated by a latex for the purpose of manufacturing a paper that can be used in an environment that must remain free of contamination. The document [22] described the addition of latex in the bulk of a tracing paper in order to improve its mechanical resistance properties to folding and tensile strength, while the document [23] proposes the addition of a copolymer obtained via polymerization of one or several unsaturated monomers and a carbohydrate compound to improve the mechanical resistance. Finally, the document [24] relates to a hydrophobic flat support, comprising at least the following elements: a fibrous mat based on cellulosic fibres and glass fibres, a fluorinated resin providing hydrophobic properties to the fibrous mat, a polymeric binder in the form of latex for attaching the glass fibres to the cellulose fibres.

None of these documents describing the use of latex addresses the interest that a composition used in the manufacture of a product by the papermaking route could have, wherein the addition of a polymer in the form of latex would actively contribute to the effectiveness of the impregnation carried out in supercritical-pressure fluid, in particular to carry out dyeing after having completed the production of the paper, and in particular to prevent the bleeding of the dye or dyes in contact with water and allow the homogeneous distribution thereof at the core and/or on the surface of the paper.

These documents also do not address the problem of the coloration or impregnation resistance by molecules of interest, in contact with water when said coloration or impregnation is obtained by implementing a method after the paper has been manufactured.

Thus, unexpectedly, the colored or impregnated paper by means of a supercritical-pressure fluid, at the end of a method implemented after the manufacture of paper and involving a step of impregnation by means of a supercritical-pressure fluid when said paper has been manufactured using a pulp incorporating, at the core, a polymer-based composition in the form of latex, or when the paper manufactured has, a layer of such polymer on the surface, has a very strong intensity of color and also a homogeneity in the coloration in the thickness when said polymer is introduced in bulk, mechanical properties equivalent or even improved compared to a conventional impregnated or colored paper, as well as remarkable resistance to bleeding with water.

The invention therefore relates, according to a first aspect, to a method of impregnating paper by means of a supercritical-pressure fluid, in particular such a method for the coloring of paper and a method for manufacturing impregnated paper, in particular colored paper, as well as, according to a second aspect, impregnated paper, in particular colored, uniformly throughout its thickness and/or its surface and whose color does not bleed in contact with water. The invention makes it possible to produce impregnated paper, in particular colored paper, more ecologically (without releasing molecules, in particular dyes in the water of the paper machine, wasting dye, incorporating easy recycling of the $CO_2$ used as a vector of coloring) but also economically by eliminating the operation via color campaign in paper mills, thereby reducing the need to build up stocks and allowing on-demand manufacturing on minimum quantities well below what is possible to offer at the present time.

The invention therefore relates to a method for impregnating a paper, in particular a method for dyeing, by means of a supercritical-pressure fluid, characterized in that it comprises a step of impregnation by contacting a paper with molecules of interest in the presence of a fluid in the supercritical or subcritical state, said paper comprising, (i) at the core, a polymeric additive introduced in the form of latex and/or, (ii) on the surface, a polymeric additive applied in the form of latex, identical or different from the latex polymer possibly present at the core and/or a molecule, in particular a polymer, which can be impregnated by a molecule of interest, in particular a hydrophobic molecule, by means of the supercritical-pressure fluid.

According to an advantageous embodiment of the invention, the paper intended to be brought into contact with the molecule of interest comprises, at the core and/or on the surface, a polymeric additive introduced in the form of latex. According to a particular embodiment of the invention, the paper intended to be brought into contact with the molecule of interest comprises, at the core and/or on the surface, a polymeric additive introduced in the form of latex.

Advantageously, the method for dyeing is carried out on dry paper. Preferably, the paper has the form of a sheet, said sheet being able to take the form of a continuous strip or a roll. In a particular embodiment of the invention, the additional surface treatments that are optionally applied to the produced sheet as well as the finishing operations (calendering, smoothing, coating) are carried out prior to the impregnation thereof, in particular prior to the dyeing thereof.

In a particular embodiment, the supercritical-pressure fluid used in the context of the method for dyeing is carbon dioxide. In a particular embodiment, said fluid is used in the supercritical state for the step of impregnation or alternatively in the subcritical state.

In a particular embodiment, the carbon dioxide is mixed with an organic solvent, for example an alcohol, in particular ethanol. For example, the supercritical-pressure fluid is $CO_2$ mixed with 1 to 20% by weight of ethanol.

In another particular embodiment, the fluid is chosen from ethylene, propylene, ethane, propane, butane, nitrogen protoxide, fluorocarbons or is a mixture of one of these fluids with a suitable organic solvent such as an alcohol, for example ethanol.

The term "supercritical-pressure fluid" or, for convenience, in the absence of a connection to specific conditions hereinbelow described "supercritical fluid" in the context of the invention, is used for a compound chosen for its ability to solubilize the molecules of interest, in particular hydrophobic molecules and preferably dyes, when it is brought to a supercritical state or alternatively to the subcritical state. In the subcritical state, only the pressure is supercritical. In the supercritical state, the temperature and the pressure are supercritical. These states are therefore characterized by determined conditions of temperature and of pressure that are known to those skilled in the art for each type of fluid. By way of example, carbon dioxide in the supercritical state ($CO_2SC$) is obtained at a temperature greater than or equal to 31° C. and at a pressure greater than or equal to 75 bars. Preferably, for the carrying out of the invention, the temperature is greater than or equal to 70° C. or 100° C. It is preferably less than 200° C., for example less than or equal to 150° C., in particular in the range from 70° C. to 130° C. Preferably, the pressure of the supercritical fluid is greater than or equal to 200 bars. This pressure is advantageously less than 1000 bars and in particular less than or equal to 400 bars. Advantageously, the supercritical $CO_2$ is obtained in the context of the invention, at 100° C. and 300 bars. The carbon dioxide in the subcritical state is obtained at a temperature less than 31° C. and at a pressure greater than 74 bars. To do so, the temperature may in particular be less than 31° C. and the pressure may be greater than or equal to 200 bars. The pressure is advantageously less than 400 bars and advantageously about 300 bars.

The transition to the supercritical fluid state of $CO_2$ is described in the examples. According to a particular embodiment, the supercritical state is reached by gradually increasing the pressure in the reactor. In the same way, it is possible to prepare the $CO_2$ in the subcritical state or any other supercritical-pressure fluid among the examples given, by applying similar conditions for a determined temperature and pressure according to the fluid.

The conditions of temperature and pressure of the fluid in the supercritical state can also be adjusted by those skilled in the art, according to the solubility of the molecules used in particular for dyeing and, where applicable, according to their sensitivity to the operating conditions, for example to a high temperature.

The method implemented as such makes it possible to obtain impregnated papers, in particular colored papers which show a stable impregnation and in particular do not bleed when in contact with water.

When the paper is treated with the supercritical-pressure fluid in order to be colored, dye molecules or reactive disperse dyes are advantageously used. In the context of the invention, the dye molecules are formed by a dispersed hydrophobic dye or a mixture of dispersed hydrophobic dyes, the dye or dyes being optionally pre-treated in order to eliminate the dispersing agents, the dye or dyes being provided from 0.1% to 10%, for example from 1 to 10%, in particular from 1% to 5%, in particular about 2.5% to 5% by dry weight of dye or dyes relative to the weight of the paper or, if the dispersing agents are present, from 0.1 to 20%, in particular from 2 to 10% by dry weight of dye or dyes relative to the weight of the paper.

The dyes used are advantageously commercially available dyes, such as those illustrated in the examples. These are hydrophobic dyes that are present or prepared by the operator in the form of powder that is dispersible in water or liquid, already dispersed in water and which are used as such or after treatment (for example via extraction with acetone) in order to remove the dispersing agents therefrom. When the dye is used with dispersant, the formulation most often comprises 50% of dispersants relative to the total weight of said formulation of dye or dyes.

For the purposes of illustration, dyes of the dispersed dye type can be used in the context of the method of dyeing, these dyes being characterized by the absence of solubilization groups and a low molecular weight. These dyes can be simple azo compounds, anthraquinone compounds, dyes of the methine-, nitro- and naphtho-quinone type.

The relative quantity of dye added into the reactor for carrying out the method for dyeing according to the invention varies according to the quantity of paper to be treated and, where applicable, the properties of the paper. In a particular embodiment of the invention, the dye or the mixture of dyes is added at a level from 0.1% to 10%, for example from 2 to 10% by dry weight of dye or dyes relative to the weight of the paper, in particular at a level from 2.5 to 5% by dry weight of dye or dyes relative to the weight of the paper or, if the dispersing agents are present, at a level from 0.1 to 20%, in particular from 2 to 10% by dry weight of dye or dyes relative to the weight of the paper.

Other hydrophobic molecules may further be added or substituted for the dyes for impregnating the paper by means of the method for impregnating, such as optical brighteners, fluorophores, antioxidants, molecules that absorb ultraviolet rays, surfactants, polymers, in particular polymers suitable for transparentizing the paper, i.e. polymers soluble in $CO_2SC$ (having a low molecular weight) and whose refractive index is close to that of cellulose (1.47), paraffinic waxes and other molecules provided with particular functional characteristics such as electrically conductive or insulating products, thermally conducting or insulating products.

In a particular embodiment of the invention, an intense coloration is obtained when it is measured by its K/S value (determined by Kubelka-Munk's equation), for example a coloration of which the K/S is greater than or equal to 3, advantageously greater than or equal to 5.

The method for impregnating, in particular dyeing, according to the invention is advantageously a method in two phases or steps: the first step is that of impregnating the paper with the dye or the molecule of interest chosen and the second step is a sweeping with clean supercritical-pressure fluid (i.e. not loaded with dye, respectively with the molecule of interest to be impregnated) in such a way as to eliminate the dye, respectively the molecule that has not impregnated the paper.

According to a particular embodiment of the invention, the method for impregnating paper in particular with a dye or a mixture of dyes by means of a supercritical-pressure fluid, comprises the steps of:

a) Loading into a reactor, a dry paper to be impregnated and a determined quantity of molecule of interest, in particular a dye or a mixture of dyes, followed by closure of the reactor,
b) Loading a fluid, in particular $CO_2$, at the storage pressure of the fluid,
c) Heating the reactor and/or pumping the fluid until obtaining the conditions of pressure and temperature that allow the solubilization of the molecule of interest, in particular the dye or dyes, in the fluid in the supercritical or subcritical state and impregnating the molecule of interest, in particular the dye or dyes, in the thickness of the paper,
d) Circulating the supercritical-pressure fluid loaded with the molecule of interest, in particular the dye or dyes, through the paper,
e) Sweeping with clean fluid at supercritical pressure, under conditions of temperature and pressure that are supercritical or, where appropriate, subcritical, identical or different from those of the step c., in order to eliminate the non-fixed molecule of interest, in particular the non-fixed dye or dyes,
f) Depressurizing the reactor to precipitate the remaining dye or dyes and allowing the fluid in the supercritical or subcritical state to return to the gaseous state,
g) Recovering the dry paper, colored at the core and/or on the surface.

The fluid is said to be "clean" insofar as it has not been used in the context of steps b) to d) above and is therefore not loaded with the molecule of interest to be impregnated.

In a particular embodiment of the method thus defined, the supercritical-pressure fluid is carbon dioxide and the temperature during the supercritical-pressure impregnation phase is greater than or equal to the ambient temperature and in particular less than or equal to 200° C., for example less than or equal to 150° C., in particular n the range from 70°

C. to 130° C. and the pressure during the supercritical-pressure impregnation phase is greater than or equal to 75 bars and less than 1000 bars, in particular in the range from 150 bars to 500 bars, preferably is 300 bars.

The step of transition of the fluid to the supercritical state or to the subcritical state can be done through a progressive increase of the pressure in the reactor or, alternatively, by a quick increase of the pressure in order to reach the supercritical pressure.

The step of heating and/or of pumping can be arranged according to the supercritical or subcritical conditions to be reached. If the heating and the pumping are carried out, they can be carried out in any order. It is, for example, possible to reach the conditions of temperature of 100° C. and pressure of 75 bars without a pumping step. It is possible to reach the conditions of temperature less than 31° C. and pressure of 300 bars without carrying out the step of heating.

The pumping of the fluid is also advantageously implemented when the paper is introduced into the reactor in the form of a roll: pumping allows the circulation of the supercritical fluid (as forced flow) in the reactor and thus promotes dyeing in the thickness of the roll radially from the inside to the outside at the core of the paper.

In order to produce paper that is ready to be impregnated, in particular colored, by means of the method according to the invention, a paper pulp based on cellulose fibers suspended in water is prepared according to the methods well known to those skilled in the art, and a polymeric additive in the form of a latex composition is incorporated in bulk into the suspension. As such in the context of the invention, the polymeric additive is formulated in the form of a latex, from a hydrophobic polymer. The molecules of polymer are stabilized by means of a surfactant in water and, when dried, form a polymeric network that is insoluble in water.

Alternatively, if the latex is to be added only on the surface of the paper, it is for example applied by a step of size-press during a step of treatment after the preparation of the sheet of paper.

As such, according to a particular embodiment, the paper can be obtained from a paper pulp comprising:

i) a fibrous suspension based on cellulose fibers in water having a concentration of cellulose fibers from 2 to 50 g/I, preferably from 15 to 25 g/I, the cellulose fibers being optionally comprised of a mixture of cellulose fibers of different origin and/or size, said suspension being refined to a degree of at least 17° SR, preferably from 20° SR to 45° SR, for example from 30 to 35° SR.

ii) a polymeric additive in the form of latex, said latex being added to the fibrous suspension in a proportion from 0.5 to 50% by weight of dry product, in particular from 0.5 to 20% by weight of dry product, preferably from 1 to 15% by weight of dry product and more preferably from 1 to 10%, from 1 to 5% or from 5 to 10% by weight of dry product, relative to the dry weight of the cellulose fibres.

The refining measured in Shopper-Riegler degrees is adjusted according to the mechanical or optical properties of the paper.

Alternatively, the paper may be obtained:

i) from a paper pulp comprising a fibrous suspension based on cellulose fibers in water having a concentration of cellulose fibers from 2 to 50 g/I, preferably from 15 to 25 g/I, the cellulose fibers being optionally comprised of a mixture of cellulose fibers of different origin and/or size, said suspension being refined to a degree of at least 17° SR, for example from 20° SR to 45° SR, preferably from 30° SR to 35° SR, and optionally a polymeric additive in the form of latex, said latex being added to the fibrous suspension in a proportion from 0.5 to 50% by weight of dry product, in particular from 0.5 to 20% by weight of dry product, preferably from 1 to 15% by weight of dry product and more preferably from 1 to 10% or from 1 to 5% or from 5 to 10% by weight of dry product, relative to the dry weight of the cellulose fibers and ii) according to a method of manufacturing paper comprising a step of depositing on the surface of the paper a polymeric additive in the form of latex in a proportion of from 0.5 to 25% by weight, in particular from 0.5 to 15% or from 0.5 to 10%, relative to the weight of the paper.

Whether it is introduced in bulk into the paper pulp or deposited on the surface of the prepared paper, the latex used in the context of the invention is an aqueous dispersion of polymer, in particular of copolymer, or an aqueous emulsion of polymer, in particular of copolymer.

In a particular embodiment, the latex is an ionic dispersion of polymer, in particular copolymer. In another particular embodiment of the invention, the latex is a non-ionic dispersion of polymer, in particular copolymer. A polymer or a copolymer for the preparation of the latex may be hydrocarbon, fluorocarbon or of the organosiloxane type; the monomers that form the polymer may or may not be organized in the form of a three-dimensional network, before or after the implementation of the method of preparing paper. It is therefore, for example, thermoplastic polymers. By way of example, a latex used in the context of the invention may be crosslinkable (for example thermally crosslinkable or self-crosslinking) and be used in the crosslinked form.

In a particular embodiment of the polymeric additive intended for use in the form of latex, the particles of polymer are formed from monomers or prepolymers capable of thermally polymerizing or via a chemical polymerization initiator contained in the particle. The latex obtained can then have the form of an emulsion, such as, for example, the latex of fluorinated resin.

In a particular embodiment of the invention, the latex is an aqueous ionic dispersion of particles of polymer, in particular of copolymer, where applicable crosslinked or crosslinkable, in particular thermally crosslinkable or thermoplastic or self-crosslinking, in particular the chains of which comprise basic groups in terms of Lewis, for example ethers, carbonyl, carboxyl or phenyl groups or mixtures thereof, said polymer or copolymer having a glass transition temperature less than 100° C., preferably within the range from −20° C. to 90° C., in particular from 0° C. to 60° C. for example from 30 to 35° C.

According to a particular embodiment of the invention, the latex is obtained from a copolymer, at least one of the monomers of which is chosen from ether monomers, vinyl monomers, styrene monomers, acrylic monomers, in particular methacrylic, urethane and dienic monomers.

According to a particular embodiment of the invention, the latex is a polymer chosen from the group of copolymers based on acrylate or acrylic ester, copolymers of styrene butadiene, copolymers of ethylene and vinyl acetate, polyurethanes or ether-urethane copolymers, copolymers of vinyl chloride and ethylene.

Particularly advantageously, the latex is a polymer chosen from the group of styrene-butadiene copolymers in particular a carboxylated styrene-butadiene copolymer of styrene-acrylic copolymers, for example copolymers of styrene and acrylic ester, acrylic ester-acrylonitrile copolymers, vinyl acetate-ethylene copolymers, ether-urethane copolymers. Also described are vinyl chloride-vinyl acetate copolymers and vinyl chloride-vinyl acetate-ethylene copolymers.

In particular, among the copolymers based on acrylate or acrylic ester, the invention may be carried out by using a copolymer of styrene and acrylate (in particular butyl acrylate), a copolymer of acrylic ester and acrylonitrile, a copolymer of acrylate and vinyl acetate, a polyacrylate or a copolymer of acrylic ester, styrene and acrylonitrile. Advantageously, among these copolymers, copolymers of styrene and acrylate (in particular butyl acrylate), copolymers of acrylic ester and acrylonitrile and copolymers of acrylate and vinyl acetate will be chosen.

In another particular embodiment of the invention, the copolymers are, for example, chosen from copolymers of styrene and acrylate (in particular butyl acrylate), copolymers of acrylic ester and acrylonitrile, copolymers of acrylate and vinyl acetate, styrene butadiene copolymers, copolymers of ethylene and vinyl acetate, polyacrylates, ether-urethane copolymers, copolymers of acrylic ester, styrene and acrylonitrile, polyurethanes, copolymers of vinyl chloride and ethylene. Advantageously, among these copolymers, copolymers of styrene and acrylate (in particular butyl acrylate), copolymers of acrylic ester and acrylonitrile and copolymers of acrylate and vinyl acetate, copolymers of styrene butadiene, copolymers of ethylene and vinyl acetate will be chosen.

The inventors have observed that the selected latexes advantageously have the capacity to swell in the supercritical-pressure fluid, in particular in $CO_2SC$ and consequently, they are readily impregnated in the paper with the molecule chosen and in particular with the dye. The swelling is also favored when the polymers have a low molecular weight, and/or have a substantial free volume, and/or a low degree of crystallinity, and/or a low crosslinking rate.

It is important for the implementation of the invention that the polymer in the form of latex has a low glass transition temperature, and lower than the temperature of the supercritical conditions applied, in particular less than 100° C. and for example, preferably within the range from −20° C. to 90° C., in particular from 0° C. to −60° C., for example from 30 to 35° C.

The latex used is advantageously chosen so as not to negatively affect the mechanical properties, ageing and/or printability of the paper sheet. It is also advantageously chosen so as not to hinder the manufacture of the paper sheet in the paper machine. In particular, the invention advantageously makes it possible to prepare papers having a satisfactory degree of water absorption translated by the Cobb value and satisfactory mechanical strength properties, in particular measured in terms of burst index (corresponding to the ratio of burst strength/basis weight), tear index (corresponding to the ratio of tearing strength/basis weight) and breaking length. The values are provided for the purposes of illustration in the Examples hereinafter.

To promote the attachment of the latex to the cellulose fibers, the paper pulp or the composition of latex may further comprise a retention agent formed by a cationic compound capable of attaching the latex to the cellulosic fibres.

When the cellulose fibers have a slightly anionic nature, if the latex is also anionic it creates ionic bonds with the cellulosic fibers via a cationic agent. Under these conditions, the latex is fixed (retained) in the fibrous mat or network during the step of drainage during the manufacture of the paper. When the latex is—more rarely—cationic it is able to be fixed spontaneously on the cellulose fibers.

Such a retention agent is, for example, a cationic compound chosen from cationic flocculation agents, cationic resins capable of reacting with cellulosic fibers, in particular crosslinkable resins on the cellulosic fibers, and cationic starch.

Advantageously, the cationic resin is a polyamide-amine-epichlorhydrin resin (also called PAAE or PAE).

In a particular embodiment of the invention, the cellulose fibers of the paper pulp are a mixture of fibers of different lengths chosen from short fibers of length within the range from 0.1 to 0.49 mm, medium fibers of length within the range from 0.5 to 1.5 mm and long fibers of length within the range from 1.6 to 3 mm.

In another embodiment of the invention, the proportion of cellulosic fibers of a first determined length is from 40 to 50% and the proportion of cellulosic fibers of a second determined length is from 60 to 50%, in particular the mixture is comprised of 40% long fibers and 60% short fibers or is comprised of 50% long fibers and 50% short fibers.

In a particular embodiment of the invention, the retention agent/latex ratio expressed as a percentage of dry retention agent/dry weight of latex is chosen in a range from 0.1% to 20%, in particular from 0.1 to 15%, and preferably from 0.1% to 13%. In particular, when the cationic retention agent is PAAE, said ratio may be n the range from 5% to 13% when the latex is anionic and in particular chosen from the group of styrene-butadiene copolymers, in particular a carboxylated styrene-butadiene copolymer, styrene-acrylic copolymers, acrylonitrile-acrylic ester copolymers, vinyl acetate-ethylene copolymers, ether-urethane copolymers and vinyl chloride-vinyl acetate-ethylene copolymers, in particular is a latex such as illustrated in the examples.

Other compounds may be added to the paper pulp in order to adjust the composition thereof according to the paper to be prepared. These compounds are commonly used in the paper-making sector. This can be fillers (calcium carbonates, kaolin, talc, titanium dioxide), pigments, bonding agent, dry resistance agent, wet resistance agent, fluorescent agent, fire-proofing agent, liquid barrier or gas barrier product.

The invention also relates to a method for manufacturing paper impregnated with a molecule of interest, in particular colored paper, comprising the following steps:

a. Preparing in a pulper a paper pulp according to the terms described hereinabove or in the following examples and preparing the sheet of paper,
b. Loading the paper, the molecule of interest, in particular the dye and the fluid into the reactor, said fluid being in particular $CO_2$, at the storage pressure of the fluid,
c. Heating the reactor and/or pumping the fluid until obtaining pressure and temperature conditions that allow the solubilization of the molecule of interest, in particular of the dye or dyes, in the fluid in the supercritical or subcritical state and the impregnation of the molecule of interest, in particular the dye or dyes, in the thickness of the paper,
d. Circulating the supercritical-pressure fluid loaded with molecule of interest, in particular dye or dyes, through the paper,
e. Sweeping with clean fluid at supercritical pressure under conditions of temperature and pressure that are supercritical or, where appropriate subcritical, identical or different from those of the step c., to eliminate the non-fixed molecule of interest, in particular the non-fixed dye or dyes, f. Depressurizing the reactor to precipitate the remaining dye or dyes and allowing the fluid in the supercritical or subcritical state to return to the gaseous state, g. Recovering the dry paper, impregnated, in particular colored, at the core and/or on the surface.

The invention also relates to the manufacture of impregnated paper by means of a supercritical-pressure fluid, in particular colored paper, comprising the following steps:

a. Preparing in a pulper a paper pulp such as described here, b. If needed, adjusting the prepared pulp and/or diluting to the desired concentration, before it is sent into the headbox for the purpose of homogeneous distribution in particular on the wire cloth of a flat table, c. Draining the pulp distributed beforehand over the wire cloth of the paper machine, the drainage being in particular carried out via gravity and by suction using suction boxes, to produce a sheet of paper, d. Dewatering the sheet obtained in the step c., for example by means of a press comprised of cylinders and where applicable drying felt for example by means of steam-heated cylinders to obtain a sheet with the moisture content less than or equal to 7% e. Where applicable, applying a surface treatment to the dried sheet, for example a sizing by means of a size or a bath of a determined composition, supplied by a size-press, f. Where applicable, drying in a post-drying zone, g. Where applicable, modifying the surface state of the sheet by an operation of calendering or smoothing, or coating, h. Impregnating, in particular dyeing, the sheet obtained by implementation of the method according to the invention.

The fabrication of the paper may include a physico-chemical surface treatment step of the sheet of paper, in particular treatment by applying, in particular by coating, a polymer in the form of latex (identical or different from the latex incorporated in the bulk) or another polymer. This step may further improve the retention of the molecules impregnated in the paper, in particular that of the dye in the paper when it has been colored.

The invention also has for object colored paper obtained by the implementation of a method according to any of the aforementioned embodiments. A particular colored paper according to the invention is a paper colored by means of a supercritical-pressure fluid, the color of which is stable in a water bleeding test and having for example a composition of short fibers and long fibers in a ratio of 50/50, said paper being for example refined to 30-35° SR and comprising a polymeric additive in the form of latex in a proportion such as defined hereinabove and in the Examples, in particular comprising from 1 to 5% of polymer introduced by mass in the form of latex retained in the fibres by means of a cationic retention agent and comprising on the surface a layer of a polymeric additive according to the proportions defined hereinabove or in the Examples, in particular comprising from 0 to 20%, preferably from 10 to 15% or 0.5 to 15% or from 0.5 to 10% by dry weight of polymer in the form of latex relative to the dry weight of the paper, said polymeric additive on the surface being identical or different from the polymeric additive introduced in bulk.

The paper according to the invention has in particular mechanical properties preserved after impregnation and in particular after dyeing such as at least one of the following properties: a satisfactory water absorption degree translated by the Cobb value, satisfactory mechanical resistance properties, in particular measured in terms of the burst index (corresponding to the burst strength/basis weight ratio), tear index (corresponding to the tearing strength/basis weight ratio) and breaking length. The values are provided for the purposes of illustration in the Examples hereinafter.

The invention shall be illustrated and described in more detail in the following examples and figures.

FIG. 1 describes the diagram of supercritical $CO_2$ impregnation assembly. The references numbered 1 to 7 designate the valves with function as shown in the following examples.

Figure 2:
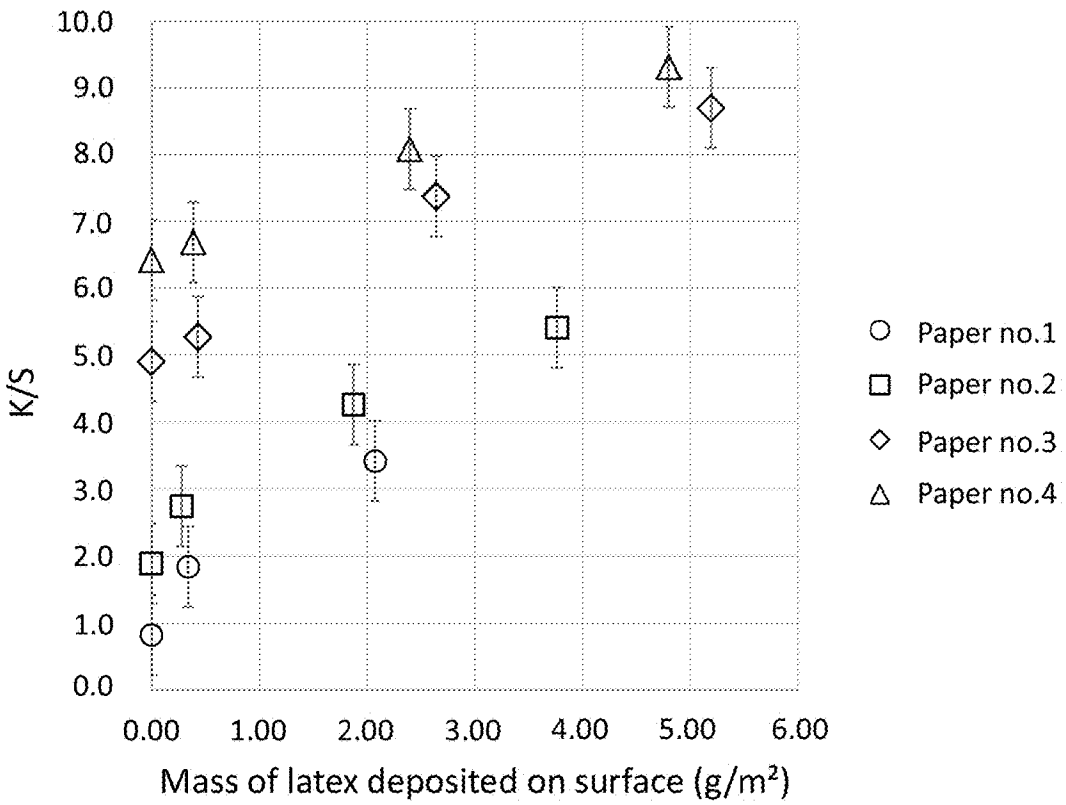

FIG. 2 shows the values of K/S for the equation $K/S=(1-R)^2/2R$ which determine the color intensity of the treated papers. In this equation, R is the minimum value of the reflectance curve, which is measured over the range of the wavelength between 400 and 700 nm using a spectrophotometer. The term (K/S), proportional to the dye concentration, evaluates the color intensity.

EXAMPLE 1

Sheet former containing 1, 5 or 10% of a polymer introduced in the form of latex in bulk, retained in the fibrous mat thanks to a polyamide-epichlorhydrine (PAE) type resin.

a) Preparation of the Fibrous Suspension and the Various Elements Used in the Composition i. Preparation of the Fibrous Suspension The composition chosen is a mixture of long fibers (Sodra Black R®) and short fibers (Cenibra®). Note that the fibers of the Cenibra® type are cellulosic wood fibers derived from eucalyptus, with an average length within the range from 0.5 to 1.5 mm, and that the fibers of the Sodra Black R® type are long cellulosic wood fibres derived from softwoods, with an average length within the range from 1.5 to 3 mm. At 500 g of pulp, formed from a mixture at ⅗ of the Cenibra® type fibers and ⅖ of the Sodra Black R® type fibers, 22 L of water is added then refining is carried out until a refining degree of about 45° SR (or Schopper-Riegler degrees) is reached.

ii. Preparation of Latexes

Different commercial latexes have been chosen and evaluated. The list and the technical characteristics provided by the suppliers are shown in Table 1.

TABLE 1

Technical data of the different latexes tested.

| Commercial name | Supplier | Chemical Nature | Styrene | Acrylate or acrylic ester | Acrylonitrile | Vinyl acetate | Butadiene | Ethylene | Ether | Urethane | Vinyl chloride | Glass transition temperature (Tg in ° C.) | pH | Dry extract (%) | Presence of plasticizer | Crosslinking nature |
|---|---|---|---|---|---|---|---|---|---|---|---|---|---|---|---|---|
| Acronal S 996 S | BASF | Aquesous dispersion of a butyl and styrene acrylate copolymer, crosslinkable in temperasture. Contains no plasticizers or solvents. | * | * with R = butyl | | | | | | | | 46 | 6 | 46 | NO | Thermal (120° C.) |
| Acronal LN 838 S | BASF | Aqueous dispersion of an acrylate ester and acrylonitrile copolymer, crosslinkable in temperature. Contains no plasticizers or solvents. | | * | * | | | | | | | 39 | 6.5 | 51 | NO | Thermal ($T_{amb}$->150° C.) |
| Acronal LN 579 S | BASF | Aqueous dispersion of an acrylate ester and acrylonitrile copolymer, crosslinkable in temperature. Contains no plasticizers or solvents. | | * | * | | | | | | | 7 | 5.5 | 50 | NO | Thermal ($T_{amb}$->150° C.) |
| Acronal 500 D | BASF | Aquesous dispersion of a, acrylate copolymer containing carboxylic and vinyl acetate groups. | | * with R sometimes = H | | * | | | | | | −13 | 3-5 | 50 | | NO (without specific additives) |
| Styrofan 2430 | BASF | Aqueous dispersion of a styrene butadiene copolymer | * | | | | * | | | | | 23 | 5.5 | 49 | | |
| Styronal D 809 | BASF | Aqueous dispersion of a styrene butadiene copolymer | * | | | | * | | | | | | 6-7 | 50 | NO | |
| Vinnapas EN 428 | WACKER | Aqueous dispersion of a self-crosslinking copolymer, without plasticizer, produced from vinyl acetate and ethylene monomers. | | | | * | | * | | | | −15 | 4-6 | 52 | NO | Thermal ($T_{amb}$->150° C.) |
| Epotal A 816 | BASF | Aqueous dispersion of an acrylate copolymer containing carboxylic groups. | | * with R sometimes = H | | | | | | | | 53 | 2-3 | 45 | | Thermal (110° C.) |
| Epotal FLX 3621 | BASF | Aqueous dispersion of a polyether polyurethane elastomer. | | | | | | | * | * | | | 7 | 53 | | |
| Acronal S 728 | BASF | Anionic aqueous dispersion of a styrene and n-butyl acrylate copolymer. Contains no plasticizers or solvents. | * | * with R butyl | | | | | | | | 23 | 6.5-7.5 | 50 | NO | |

TABLE 1-continued

Technical data of the different latexes tested.

| Commercial name | Supplier | Chemical Nature | Styrene | Acrylate or acrylic ester | Acrylonitrile | Vinyl acetate | Butadiene | Ethylene | Ether | Urethane | Vinyl chloride | Glass transition temperature (Tg in ° C.) | pH | Dry extract (%) | Presence of plasticizer | Crosslinking nature |
|---|---|---|---|---|---|---|---|---|---|---|---|---|---|---|---|---|
| Acronal LA 47 S | BASF | Aqueous dispersion of a self-crosslinking copolymer with an acrylic ester and acrylonitile base. | | * | * | | | | | | | 7 | 5.5 | 51 | | Thermal (Tamb->150° C.) |
| Acronal S 888 S | BASF | Aqueous dispersion of a copolymer (thermally crosslinkable) of acrylic ester and styrene, manufactured by a method incorporating acrylonitrile. | * | * | * | | | | | | | 31 | 8.5 | 50 | | Thermal (Tamb->150° C.) |
| Emuldur 360 A | BASF | Anionic aqueous dispersion of polyurethane. | | | | | | | | * | | — | 8 | 40 | | NO (without specific additives) |
| Acronal A 273 S | BASF | Aqueous dispersion of a copolymer (thermally crosslinkable) of different acrylates in the manufacture of which acrylonitrile is also used. | | * with different R | * | | | | | | | −36 | 3.5 | 50 | | Thermal (Tamb->120° C.) |
| Vinnol CEN 203 | WACKER | Dispersion of a self-crosslinking copolymer of ethylene and of vinyl chloride. Contains no plasticizers. | | | | | | | * | | * | 35 | 5-7 | 50 | NO | YES |
| Acronal DS 2416 | BASF | Aqueous dispersion of a copoymer with an acrylic ester and styrene base. | * | * | | | | | | | | 38 | 4.5 | 50 | | YES |
| Vinnapas SAF 364 | WACKER | Aqueous dispersion of small-size particles of a copolymer produced from styrene and acrylic ester monomers. | * | * | | | | | | | | 20 | 7.5-8.5 | 50 | | |

Repeat units present in the latexes tested

| Styrene | Acrylate or acrylic ester | Acrylonitrile |
|---|---|---|
| 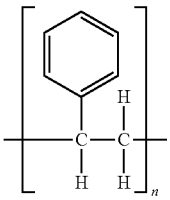 | 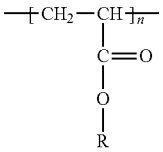 | 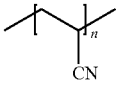 |
| Vinyl acetate | Butadiene | Ethylene |
| 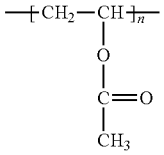 | 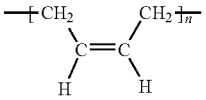 | 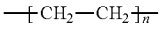 |
| Ether | Urethane | Vinyl chloride |
| 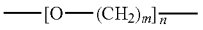 | 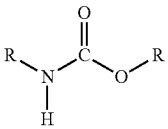 a urethane | 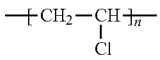 |

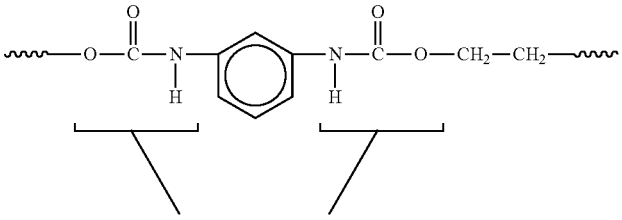

the urethane linkages in a polyurethane

Before use, each latex was diluted in order to reach a solid particle content of about 10%, controlled and recalculated by a measurement of dry extract. The pH of each latex was also adjusted to the pH of the fibrous suspension, i.e. about 7.1 and a visual inspection was conducted after a few hours or a few days in order to detect any destabilization of the solution.

iii. Preparation of the Retention Agent

The retention agent used is a cationic polyelectrolyte: a resin of the PAE (cationic polyamide-epichlorohydrine) type, Kymene 617. In the same way as above, the PAE is diluted and its pH is adjusted to 7.1.

b) Study of the Retention and Optimization of the Ratio [Retention Agent:Latex]

After having carried out the various preparations, the quantity of PAE required for the total retention of each one of the latexes on the fibres is defined in the following way:

Bottles suitable for centrifugation are filled with a known and identical quantity of fibrous suspension.

In each one of the bottles, a determined quantity of PAE is then added. As such, a series of bottles containing respectively 0%, 0.1%, 0.3%, 0.5%, 0.7%, 0.9%, 1.1%, 1.3% and 1.5% of dry PAE/mass of dry fibres is prepared and stirred for 4 min using an orbital shaker.

The latex is then added to each bottle at a level of 10% dry/mass of dry fibres. An additional bottle, referred to as the control, containing water to which the same quantity of latex will be added, is also prepared. The solutions are again stirred for 4 min using the orbital shaker.

A centrifugation of all of the bottles is carried out and the results are read. The control bottle is first examined in order to verify that no sedimentation of the latex is visible. Then the supernatants of each one of the bottles is examined, and the ratio [retention agent:latex] is determined by the presence of a perfectly transparent supernatant without Tyndall effect.

Rhe ratios [retention agent: latex] thus defined for each one of the latexes and are listed in Table 2 below:

TABLE 2

Ratios [retention agent:latex] determined by each PAE + latex pair.

| Latex | Ratio[retention agent:latex] expressed as a % of dry PAE/dry mass of latex |
|---|---|
| Acronal S 996 S | 9% |
| Acronal LN 838 S | 13% |

TABLE 2-continued

Ratios [retention agent:latex] determined by each PAE + latex pair.

| Latex | Ratio[retention agent:latex] expressed as a % of dry PAE/dry mass of latex |
|---|---|
| Acronal LN 579 S | 11% |
| Acronal 500 D | 11% |
| Styrofan 2430 | 7% |
| Styronal D 809 | 7% |
| Vinnapas EN 428 | 5% |
| Epotal A 816 | 13% |
| Epotal FLX 3621 | 13% |
| Acronal S 728 | 11% |
| Acronal LA 471 S | 11% |
| Acronal S 888 S | 7% |
| Emuldur 360 A | 5% |
| Acronal A 273 S | 13% |
| Vinnol CEN 203 | 7% |
| Acronal DS 2416 | 7% |
| Vinnapas SAF 364 | 7% |

c) Preparation of Sheet Formers

For each one of the latexes several sheet formers were prepared containing 1%, 5% or 10% of latex (dry/mass of the fibres). To do this, in a recipient under mechanical stirring, to the fibres in suspension the required quantity of PAE was added, predetermined in the preceding step. This mixture was stirred for 4 min. The latex was then added. The mixture was homogenized again 4 min before carrying out the production of the sheet. A sample can be taken and centrifuged in order to check the correct retention of the latex on the fibres.

In order to manufacture the sheet former, a sampling of the quantity of pulp required, a dilution in a sheet former device, a stirring, a filtration, a pressing and a drying were successively carried out.

d) Characterization of the Mechanical Properties of Sheet Formers

Different characteristic properties of the sheet former were evaluated: the paper basis weight and the bulk or specific volume, the resistance to bursting and tearing, but also the force at break, elongation as well as the breaking length. All of these characteristics were compared with those of a control sheet former containing only cellulose and are listed in Table 3 hereinbelow.

TABLE 3

Evaluation of the various mechanical properties of the sheet formers into which were introduced 1, 5 or 10% of latex (in dry weight/dry weight of fibres).

| Latex | % of latex introduced | Paper weight (g/m$^2$) | Main (cm3/g) | Burst (kPa) | Tear (nM) | Force at break (N) | Elongation (%) | Breaking length (km) |
|---|---|---|---|---|---|---|---|---|
| None | 0% | 114 | 1.53 | 308 | 1203 | 88.9 | 3.0 | 5.3 |
| Acronal | 1% | 107 | 1.44 | 435 | 1054 | 92 | 4.0 | 5.8 |
| S 996 S | 5% | 112 | 1.45 | 556 | 1022 | 103 | 3.5 | 6.3 |
| | 10% | 120 | 1.40 | 744 | 1079 | 144 | 4.4 | 8.2 |
| Acronal | 1% | 117 | 1.59 | 573 | 1153 | 122 | 5.6 | 7.1 |
| LN 838 S | 5% | 115 | 1.54 | 677 | 1257 | 121 | 6.4 | 7.1 |
| | 10% | 116 | 1.57 | 704 | 1140 | 127 | 5.5 | 7.5 |
| Acronal | 1% | 114 | 1.54 | 357 | 1149 | 107 | 4.4 | 6.4 |
| LN 579 S | 5% | 118 | 1.46 | 357 | 1149 | 107 | 4.3 | 6.1 |
| | 10% | 126 | 1.45 | 661 | 1148 | 131 | 6.5 | 7.1 |
| Acronal | 1% | 111 | 1.50 | 345 | 992 | 85 | 3.3 | 5.1 |
| 500 D | 5% | 115 | 1.52 | 445 | 1312 | 95 | 4.2 | 5.6 |
| | 10% | 119 | 1.47 | 505 | 1134 | 102 | 4.9 | 5.8 |
| Styrofan | 1% | 125 | 1.60 | 463 | 1110 | 85 | 4.5 | 4.6 |
| 2430 | 5% | 135 | 1.61 | 517 | 1224 | 105 | 4.5 | 5.2 |
| | 10% | 146 | 1.56 | 629 | 1428 | 133 | 5.4 | 6.2 |
| Styronal | 1% | 121 | 1.51 | 597 | 1149 | 102 | 4.7 | 5.7 |
| D 809 | 5% | 114 | 1.49 | 664 | 1071 | 121 | 5.3 | 7.2 |
| | 10% | 115 | 1.59 | 768 | 1059 | 115 | 7.0 | 6.8 |
| Vinnapas | 1% | 127 | 1.61 | 439 | 1130 | 99 | 4.8 | 5.3 |
| EN 428 | 5% | 137 | 1.62 | 461 | 1210 | 101 | 4.1 | 5.0 |
| | 10% | 109 | 1.67 | 415 | 945 | 91 | 6.0 | 5.7 |
| Epotal A | 1% | 141 | 1.59 | 481 | 1267 | 98 | 3.4 | 4.9 |
| 816 | 5% | 137 | 1.57 | 590 | 1281 | 144 | 6.4 | 7.0 |
| | 10% | 132 | 1.58 | 701 | 1349 | 130 | 5.0 | 6.7 |
| Epotal | 1% | 106 | 1.81 | 358 | 1112 | 68 | 4.3 | 4.4 |
| FLX 3621 | 5% | 105 | 1.77 | 370 | 965 | 76 | 5.6 | 4.9 |
| | 10% | 118 | 1.79 | 527 | 1157 | 95 | 5.7 | 5.4 |
| Acronal | 1% | 137 | 1.55 | 450 | 1487 | 106 | 3.5 | 4.9 |
| S 728 | 5% | 126 | 1.58 | 470 | 1130 | 101 | 5.0 | 5.6 |
| | 10% | 163 | 1.56 | 694 | 1795 | 139 | 4.9 | 5.9 |
| Acronal | 1% | 115 | 1.45 | 327 | 1122 | 82 | 3.5 | 4.8 |
| LA 471 S | 5% | 121 | 1.51 | 463 | 1161 | 107 | 4.9 | 6.0 |
| | 10% | 115 | 1.56 | 553 | 912 | 115 | 7.5 | 6.8 |
| Acronal | 1% | 117 | 1.63 | 420 | 1090 | 102 | 5.4 | 6.0 |
| S 888 S | 5% | 152 | 1.63 | 555 | 1502 | 124 | 5.4 | 5.6 |
| | 10% | 129 | 1.60 | 655 | 1182 | 124 | 5.5 | 6.5 |
| Emuldur | 1% | 147 | 1.58 | 518 | 1470 | 96 | 3.4 | 4.5 |
| 360 A | 5% | 133 | 1.61 | 448 | 1216 | 98 | 4.4 | 5.0 |
| | 10% | 129 | 1.60 | 454 | 1255 | 89 | 4.5 | 4.7 |

TABLE 3-continued

Evaluation of the various mechanical properties of the sheet formers into which were introduced 1, 5 or 10% of latex (in dry weight/dry weight of fibres).

| Latex | % of latex introduced | Paper weight ($g/m^2$) | Main (cm3/g) | Burst (kPa) | Tear (nM) | Force at break (N) | Elongation (%) | Breaking length (km) |
|---|---|---|---|---|---|---|---|---|
| Acronal | 1% | 109 | 1.68 | 387 | 1034 | 90 | 5.4 | 5.6 |
| A 273 S | 5% | 110 | 1.69 | 417 | 1149 | 76 | 4.3 | 4.7 |
| | 10% | 110 | 1.63 | 420 | 1026 | 75 | 5.1 | 4.6 |
| Vinnol | 1% | 122 | 1.68 | 446 | 1149 | 108 | 5.7 | 6.1 |
| CEN 203 | 5% | 132 | 1.63 | 499 | 1355 | 102 | 3.9 | 4.9 |
| | 10% | 128 | 1.59 | 550 | 1485 | 117 | 4.5 | 5.6 |
| Acronal | 1% | 143 | 1.60 | 440 | 12308 | 111 | 3.6 | 5.5 |
| DS 2416 | 5% | 114 | 1.58 | 526 | 1017 | 93 | 4.8 | 5.7 |
| | 10% | 158 | 1.54 | 594 | 1685 | 156 | 6.4 | 6.9 |
| Vinnapas | 1% | 141 | 1.61 | 432 | 1298 | 98 | 4.4 | 4.7 |
| SAF 364 | 5% | 119 | 1.58 | 464 | 1122 | 96 | 6.0 | 5.5 |
| | 10% | 125 | 1.55 | 522 | 1094 | 114 | 5.1 | 6.2 |

As such, it was verified that no degradation of the mechanical properties was observed following the addition of one or the other of the latexes in the sheet. The sheet formers containing a polymer in the form of latex have even better mechanical properties.

e) Dyeing of Sheet Formers

The paper produced as such was colored by a method of dyeing or impregnation by means of a supercritical fluid which is supercritical $CO_2$. For this, the paper was placed inside a closed reactor wherein a known quantity of dispersed dye was added (more preferably treated beforehand with Soxhlet extraction in order to eliminate therefrom most of the dispersants). In the context of this example, the dye used was Blue Foron RD-E (Archroma) which was pre-treated via Soxhlet extraction with acetone. It was then dried in order to eliminate any trace of solvent before being finely ground. Then, 1 g of this pre-treated dye was added to the bottom of the reactor.

This reactor was provided with an accessory which guides the flow of $CO_2$ through the paper. Paper discs of 3 cm in diameter were cut in order to be perfectly adjusted to the inner diameter of the accessory. This accessory is comprised of a hollow and threaded rod, which is connected to the internal tapping of the reactor corresponding to the flow inlet. This rod is then welded to a metal cylinder having an inner diameter is 3 cm and the lower pierced portion which can be detached from the assembly in order to introduce the samples to be impregnated.

The closed reactor was then loaded with liquid $CO_2$ to about 80-90 bars. To do this, the valves (1), (2), (3), and (4) are open, while the valves (5), (6) and (7) are closed. Then the whole was heated and the conditions were adjusted to 100° C.-300 bars. When the experimental conditions were reached (100° C.-300 bars), an overpressure is generated in the core of the reactor by starting the pump so that the supercritical $CO_2$, loaded with dye, passes through the paper for 2 hours. The excess pressure generated is continuously removed thanks to the overflow set to 300 bars. At the end of the 2 h, we conducted a sweeping of the paper with clean $CO_2$. For this, the valves (1), (3) and (4) are closed, the valve (2) remains open and the valves (5) and (6) are open. The sweeping is maintained for 5 to 10 min then the assembly is depressurized (under a light flow of clean $CO_2$) thanks to the valve (7). Depressurization, on the one hand, precipitates the dyes to the bottom of the reactor and, on the other hand, turns the fluid in the supercritical state into the gaseous state and allows to obtain at the end of the impregnation method, samples of paper that are perfectly dry and colored on the surface as well as at the core.

Kubelka-Munk's equation, $K/S=(1-R)^2/2R$, is used in order to determine the color intensity of the paper treated as such. In this equation, R is the minimum value of the reflectance curve, which is measured over the range of the wavelengths between 400 and 700 nm using a spectrophotometer. The term (K/S), proportional to the concentration in dye, evaluates the color intensity. Thus, in the context of this example and of the examples presented hereinafter, the higher K/S is, the more intense the coloration is.

Measurements were taken on these sheets. As intense level of color was obtained. Depending on the latex added and its quantity, the K/S values in Table 4 hereinbelow were obtained.

TABLE 4

Value of K/S obtained on sheet formers wherein were introduced 1, 5 or 10% of latex (in dry weight/dry weight of fibres) and coloured by impregnation with supercritical $CO_2$.

| Latex | % of latex introduced | K/S |
|---|---|---|
| None | 0% | 1.2 |
| Acronal S 996 S | 1% | 3.5 |
| | 5% | 7.3 |
| | 10% | 9.6 |
| Acronal LN 838 S | 1% | 5.0 |
| | 5% | 7.3 |
| | 10% | 9.5 |
| Acronal LN 579 S | 1% | 2.2 |
| | 5% | 6.3 |
| | 10% | 9.0 |
| Acronal 500 D | 1% | 2.8 |
| | 5% | 5.7 |
| | 10% | 8.3 |
| Styrofan 2430 | 1% | 1.4 |
| | 5% | 2.7 |
| | 10% | 6.9 |
| Styronal D 809 | 1% | 3.1 |
| | 5% | 4.2 |
| | 10% | 6.2 |
| Vinnapas EN 428 | 1% | 0.9 |
| | 5% | 1.6 |
| | 10% | 6.2 |

TABLE 4-continued

Value of K/S obtained on sheet formers wherein were introduced 1, 5 or 10% of latex (in dry weight/dry weight of fibres) and coloured by impregnation with supercritical $CO_2$.

| Latex | % of latex introduced | K/S |
|---|---|---|
| Epotal A 816 | 1% | 2.6 |
| | 5% | 5.0 |
| | 10% | 6.2 |
| Epotal FLX 3621 | 1% | 2.6 |
| | 5% | 5.0 |
| | 10% | 6.2 |
| Acronal S 728 | 1% | 1.8 |
| | 5% | 3.6 |
| | 10% | 5.6 |
| Acronal LA 471 S | 1% | 2.2 |
| | 5% | 3.5 |
| | 10% | 5.7 |
| Acronal S 888 S | 1% | 2.2 |
| | 5% | 3.5 |
| | 10% | 5.7 |
| Emuldur 360 A | 1% | 2.5 |
| | 5% | 3.3 |
| | 10% | 5.0 |
| Acronal A 273 S | 1% | 2.5 |
| | 5% | 3.3 |
| | 10% | 5.0 |
| Vinnol CEN 203 | 1% | 1.3 |
| | 5% | 3.1 |
| | 10% | 5.0 |
| Acronal DS 2416 | 1% | 2.3 |
| | 5% | 2.9 |
| | 10% | 4.1 |
| Vinnapas SAF 364 | 1% | 0.8 |
| | 5% | 2.3 |
| | 10% | 4.3 |

f) Non-Bleeding Test

The samples of colored paper were tested in contact with water according to standard EN NF 646. As such, two sheets of non-colored glass fiber paper were immersed into the test liquid: distilled water. After saturation, the latter are freed from the excess liquid by wiping them on the edge of the recipient.

A sheet of non-colored glass fibre paper was laid down, smooth face upwards, on a glass plate. The test piece (sample of paper tested) was then immediately placed on this sheet. It was covered with a second sheet of saturated glass fiber paper n such a way that the smooth face of the latter is also in contact with the test piece. Another glass plate was placed on the second sheet of non-colored glass fibre paper then the assembly was wrapped in a polyethylene film in order to prevent the edges from drying out. The assembly was placed under a load of 1 kg and left to rest for 24 hours away from any direct penetration of light.

After 24 hours, the assembly was disassembled. The sheets of non-colored glass fibre paper were placed on three adjacent glass rods, with the face having been respectively in contact with the test piece facing upwards. The sheets of glass fibre paper were protected from light by being covered without contact, then left to dry in the air at ambient temperature.

The coloration of the glass fibre papers was then evaluated in relation to a control, a new non-colored glass fibre paper. In all of the cases, no coloration was observed, which corresponds to a total absence of bleeding.

EXAMPLE 2 a) Preparation of Sheet Formers

In the same way as described in example 1, sheet formers the composition of which is detailed in Table 5 hereinbelow were prepared.

TABLE 5

Description of the sheet formers produced.

| Sheet formers containing: | 0% of latex | 1% of latex | 5% of latex | 10% of latex |
|---|---|---|---|---|
| Fibrous composition | Mixture of 3/5 Cenibra and of 2/5 Sodra Black R<br>Refining: 45°SR<br>Concentration 22.5 g/L | | | |
| Addition 1: cationic starch | Solvitove PLV<br>3% dry/fibres<br>Stirring: 50 min | Solvitove PLV<br>3% dry/fibres<br>Stirring: 50 min | Solvitove PLV<br>3% dry/fibres<br>Stirring: 50 min | Solvitove PLV<br>3% dry/fibres<br>Stirring: 50 min |
| Addition 2: calcium carbonate | Calprec PA<br>8% dry/fibres<br>Stirring: 10 min | Calprec PA<br>8% dry/fibres<br>Stirring: 10 min | Calprec PA<br>8% dry/fibres<br>Stirring: 10 min | Calprec PA<br>8% dry/fibres<br>Stirring: 10 min |
| Addition 3: latex | Acronal S 996 S<br>0% dry/fibres<br>Stirring: 10 min | Acronal S 996 S<br>1% dry/fibres<br>Stirring: 10 min | Acronal S 996 S<br>5% dry/fibres<br>Stirring: 10 min | Acronal S 996 S<br>10% dry/fibres<br>Stirring: 10 min |
| Addition 4: AKD | Aquapel F215<br>0.15% dry/fibres<br>Stirring: 2 min | Aquapel F215<br>0.15% dry/fibres<br>Stirring: 2 min | Aquapel F215<br>0.15% dry/fibres<br>Stirring: 2 min | Aquapel F215<br>0.15% dry/fibres<br>Stirring: 2 min |
| Forming | Dilution in the sheet former, stirring, draining (1 min 30)<br>Pressing (1 min)<br>Drying in temperature at 100° C.-10 min | | | |

The retention of the latex was verified by taking a sample before the production of the sheet former by centrifugation according to parameters of power and of time which were further adjusted using different control samples. The parameters chosen are such that a highly diluted solution of latex does not sediment while a solution containing a small quantity of calcium carbonate in water has a perfectly clear supernatant.

b) Characterization of the Sheet Formers

It was verified that the mechanical properties of the sheets were not altered by the presence of the polymer introduced in the form of latex. The results of the evaluation of the mechanical properties are shown in Table 6 hereinbelow.

TABLE 6

Mechanical properties of the sheet formers produced.

| Latex | % of latex introduced | Paper weight ($g/m^2$) | Main ($cm^3/g$) | Cobb (mL/min) | Burst (kPa) | Tear (mN) | Force at break (N) | Elongation (%) | Breaking length (km) |
|---|---|---|---|---|---|---|---|---|---|
| Acronal S 996 S | 0% | 111 | 1.61 | 34 | 543 | 1110 | 112 | 6.4 | 6.8 |
| | 1% | 110 | 1.55 | 32 | 521 | 1191 | 98 | 8.1 | 6.1 |
| | 5% | 112 | 1.58 | 32 | 572 | 1030 | 117 | 7.2 | 7.1 |
| | 10% | 111 | 1.54 | 26 | 575 | 1051 | 120 | 6.1 | 7.4 |

The calcium carbonate content retained in each one of the sheet formers was also estimated. The results are logged in Table 7 hereinbelow.

TABLE 7

% $CaCO_3$/total weight of the dry paper according to the percentage of latex introduced.

| Latex | % of latex introduced | % $CaCO_3$ estimated by thermogravimetric/total weight of the dry paper analyses |
|---|---|---|
| Acronal S 996 S | 0% | 7.2 |
| | 1% | 6.6 |
| | 5% | 5.8 |
| | 10% | 5.9 |

c) Coloration of the Sheet Formers

The paper produced as such was coloured by the method of coloration described in example 1 paragraph e.

Measurements via spectrophotometry were taken on these sheets. As such, a level of intense coloration was obtained and the values of K/S measured are contained in Table 8.

TABLE 8

Value of K/S obtained on sheet formers into which were introduced 1, 5 or 10% of latex (in dry weight/dry weight of fibres) and coloured by impregnation with supercritical $CO_2$.

| Latex | % of latex introduced | K/S |
|---|---|---|
| Acronal S996S | 0% | 1.2 |
| | 1% | 2.0 |
| | 5% | 5.5 |
| | 10% | 7.8 |

d) Characterization of the Bleeding

Bleeding tests were carried out according to the protocol described in example 1, paragraph f. In all of the cases, no coloration was observed after 24 hours on the non-colored glass fibre papers, which corresponds to a total absence of bleeding.

EXAMPLE 3 a) Manufacture of the Paper

A paper pulp was prepared in a pulper by mixing fibres in water. The composition of the mixture of cellulosic fibre is 50% by dry weight of short cellulosic fibres of the Cenibra type (wood fibres coming from eucalyptus) and 50% by dry weight of long cellulosic fibres, of the Pacifico type (wood fibres coming from softwoods). The pulp prepared as such was refined to a Schopper degree between 30 and 35.

To this mixture were added, based on the dry weight of the cellulose fibres, 0.6% by dry weight of latex of the Acronal S728 type, 0.4% by dry weight of fluorinated resin of the Asahi Guard E061 type and 0.1% by dry weight of cationic polyamide-epichlorhydrine resin of the Kymene 617 type (retention agent).

Before being sent to the headbox, the composition of this pulp was adjusted by continuously adding 2.5% by wet weight (in relation to the weight of the pulp before adjustment) of fluorinated resin of the Asahi Guard E061 type and 0.7% by wet weight of bonding agent of the Aquapel J215 type.

The pulp prepared as such was sent into the headbox of the paper machine then was uniformly distributed on the moving web of the flat table, where it underwent draining through the meshes of the wire cloth, by gravity and by suction using suction boxes, for the purpose of producing a sheet, as is known to those skilled in the art.

Once formed, the sheet of paper passed through the press section of the paper machine, then a dryer comprised of a series of steam-heated cylinders.

When the moisture of the sheet was greatly reduced, for example about 5%, the sheet underwent a coating treatment on the surface by passing through a size-press, comprised for example of two rollers arranged side-by-side horizontally in order to form a bowl supplied with a size of a determined composition. The sheet is then passed between the rollers in such a way as to coat its two opposite faces.

In the context of this example, the compositions of the size were as follows:

- Between 8 and 12% by dry weight of a latex of the Acronal S 728 type
- About 0.9% by dry weight of a styrene acrylic compound of the Baysize BMP type
- About 1.8% by dry weight of a polyvinylic alcohol (P.V.A.) of the BF 17 type The sheet is then passed into a so-called post-drying section, in which it again comes into contact with one or several steam-heated rollers, to a temperature of about 120° C.

b) Characterization of the Properties of the Paper

The physical properties of the paper produced as such were evaluated. Various characteristic measurements were taken, such as the tensile strength, tearing strength or bursting strength. An evaluation of the printability by measurement of the pulling off IGT was also conducted. The various results are logged in Table 9 hereinbelow.

TABLE 9

| Properties of the test roll | | | |
|---|---|---|---|
| Paper weight (g/m$^2$) | | 90 | |
| Main (cm3/g) | | 1.32 | |
| Bendtsen porosity (mL/min) | | 510 | |
| Bendtsen roughness (mL/min) | | Front | Back |
| | | 234 | 294 |
| Burst (kPa) | | 298 | |
| Tear (mN) | | Machine direction | Cross direction |
| | | 353 | 698 |
| Traction | | Machine direction | Cross direction |
| | Force (N) | 116 | 71 |
| | Elongation (%) | 2.4 | 6.1 |
| | Breaking length (km) | 8.8 | 5.4 |
| Dry pulling off IGT | | Machine direction | Cross direction |
| (pressure 35 kgf - increasing Thumbwheel | | Absence of linting | Absence of linting |
| speed 0 to 7 m/s - ink 3804) Strip | | No pulling off point | No pulling off point |
| Cobb (mL/min) | | 25 | |

c) Coloration of the Paper and Intensity Measurements

The paper produced as such was colored by a method of dyeing or impregnating by means of a supercritical fluid which is supercritical $CO_2$. For this, a roll of paper was placed inside a closed reactor wherein a known quantity of dispersed dye was added (more preferably treated beforehand with Soxhlet extraction in order to eliminate therefrom most of the dispersants).

In the context of this example, several dyes or mixture of dyes were used. These dyes are all commercial dispersed dyes supplied by Archroma and were all pre-treated via Soxhlet extraction with acetone. As such, the following colorations were successively carried out:

Yellow coloration with Yellow Foron Brilliant RD-E

Green Coloration using a mixture Yellow Foron Brilliant RD-E (75%) and Blue Foron RD-E (25%)

Blue coloration with Blue Foron RD-E

Black coloration noire with Black Foron RD-RM 400

The reactor used is designed so that the flow of $CO_2$ is guided through the thickness of a roll of paper. After loading of the paper, a quantity of dye equivalent to 2.5 to 5% of the weight of the paper to be impregnated was placed in the reactor. Once the reactor is closed, the first step consisted in loading the reactor with $CO_2$ at the storage pressure (40-50 bars) then simultaneously the reactor was heated and $CO_2$ pumped in order to reach the working conditions: a temperature between 100 and 115° C. and a pressure between 270 and 300 bars. A circulation was provided using a pump. As such, the supercritical $CO_2$ loaded with dissolved dye was sent through the thickness of the roll, radially from the inside to the outside. After 2 hours in the predefined supercritical conditions, a sweeping was carried out with clean $CO_2$ at a temperature of 100 to 115° C. and at a pressure of 250 bars for 30 min in order to eliminate the non-fixed dye before depressurizing which generated on the one hand, the precipitation of the remaining dye and, on the other hand, turned the fluid in the supercritical state into the gaseous state. At the end of the impregnation method, perfectly dry paper samples, colored on the surface as well as at the core, and whose color does not bleed when in contact with water were obtained.

Measurements via spectrophotometry were taken on these sheets. As such, levels of intense color were obtained and the values of K/S measured at the maximum absorption wavelengths are shown in Table 10 hereinbelow.

TABLE 10

Value of K/S obtained on the test rolls colored by impregnation with supercritical $CO_2$ in different colours.

| Colour | Dye | Wavelength corresponding to the peaks or absorption maximums (nm) | K/S |
|---|---|---|---|
| Yellow | Yellow Foron Brilliant RD-E | Yellow: 460 | 4.6 |
| Green | Yellow Foron Brilliant RD-E (75%) + Blue Foron RD-E (25%) | Yellow: 440<br>Bleu: 620 | 5.8<br>2.1 |
| Blue | Blue Foron RD-E | Bleu: 580 | 6.7 |
| Black | Black Foron RD-RM 400 | Maximum: 600 | 6.3 |

d) Bleeding Tests

Bleeding tests were carried out according to the protocol described in example 1, paragraph f. In all of the cases, regardless of the dye or mixture of dyes used, no coloration was observed after 24 hours on the non-coloured glass fibre papers, which corresponds to a total absence of bleeding.

EXAMPLE 4 a) Manufacture of the Paper

Papers having the compositions identical to those of the sheet formers presented in the example 2 are produced.

As such, a paper pulp is prepared in a pulper by mixture of fibres in water. The composition of the mixture of cellulosic fibre is ⅗ of short cellulosic fibres of the Cenibra type (wood fibres from eucalyptus) and ⅖ of long cellulosic fibres, of the Sodra Black R type (wood fibres from softwoods). The pulp thus prepared is refined to a Schopper degree between 40 and 42.

To this mixture is added, relative to the dry weight of the cellulose fibres, 3% of cationic starch (Solvitose PVL prepared at 3% in water). The mixture is stirred for about 1 h. Then, fillers of the calcium carbonate type (Calprec PA) are introduced into the mixture at a rate of 8% by dry weight relative to the dry weight of the fibres and stirred for 20 minutes.

According to the paper desired, a defined quantity of latex is then added. The papers no. 1, 2, 3 and 4 correspond to the addition respectively of 0, 1, 5 and 10% dry relative to the weight of the fibers of a butyl acrylate and styrene latex, Acronal S 996 S. The mixture is then homogenized for 10 to 20 minutes before it is sent to the headbox.

During the transfer of the pulp to the headbox, the composition of this pulp is adjusted by the continuous adding of 0.15% by dry weight relative to the weight of the fibers of a bonding agent of the AKD type (alkylketene dimers). In the context of this example, Aquapel F215 is used.

The pulp thus prepared is sent into the headbox of the paper machine and then uniformly distributed on the moving web of the flat table, where it will undergo draining through the meshes of the wire cloth, by gravity and by suction using suction boxes, for the purpose of producing a sheet of 80 g/m$^2$, as known to those skilled in the art.

Once formed, the sheet of paper passes through the section of the presses of the paper machine, then a dryer comprised of a series of stem-heated cylinders.

After cutting of this paper into a format, a post-treatment is carried out in the laboratory. The sheet undergoes coating treatment on the surface by passing through a laboratory size-press, comprised of two rollers arranged side-by-side horizontally in order to form a bowl supplied with a size of a determined composition. The sheet is then passed between the rollers in such a way as to coat its two opposite faces. This post-treatment is representative of a treatment in size-press on an industrial paper machine.

In the context of this example, the compositions of the sizes are as follows:

TABLE 11

Composition of the sizes used during deposits in size-press.

| Aqueous sizes containing: | | | |
|---|---|---|---|
| Total dry extract | 2.7% | 10.7% | 20.6% |
| Addition 1: | Acronal S 996 S (commercial solution at 46% in water) | | |
| latex | 2% dry | 10% dry | 20% dry |
| Addition 2: | Blanose 7M65 (preparation at 2% in water | | |

TABLE 11-continued

Composition of the sizes used during deposits in size-press.

| Aqueous sizes containing: | | | |
|---|---|---|---|
| rheological agent | 0.71% dry | 0.66% dry | 0.61% dry |

The exact masses deposited on each sheet are then calculated using the actual dry extracts of the sizes and of the wet masses deposited per surface unit.

The sheet then goes into an oven at a temperature of about 120° C. for 2 minutes.

b) Dyeing of the Sheets

The paper produced as such is colored by the method of dyeing described in example 1 paragraph e.

Measurements via spectrophotometry were taken on these sheets. As such, a level of intense color can be obtained and the values of K/S measured are represented on the graph in FIG. 2.

The papers produced without depositing latex on the surface are homogeneously colored over the entire thickness. As the intensity of the color depended on the quantity of latex added, it is thus possible to produce paper having the colors varying from a pastel tone to a very intense color.

The adjustment of the ratio of latex between the bulk and the surface makes it possible in certain cases to increase the intensity of color while still retaining homogeneity in the color in the thickness of the paper. This is the case for example of paper no. 3 containing 5% of latex in mass and on which a deposit on the surface of 2.7 g/m$^2$ was conducted.

In other cases, this produces low-end papers by limiting the quantity of latex used. The latter, for example the paper no. 2, on which a deposit of 3.76 g/m$^2$ of latex was carried out, has a strong intensity of coloron the surface but a color gradient is visible during tearing.

COMPARATIVE EXAMPLE 5

A colored paper was produced according to the teaching of patent application FR 3 015 988 by using amphiphilic molecules (CTAB and AOT in an equimolar mixture) as additives for the preparation of the paper.

a) Manufacture of the Paper

TABLE 12

Description of the manufacture of sheet formers

| Sheet former | Control (without surfactants) | CTAB:AOT in a ratio 1:1 w/w | |
|---|---|---|---|
| Fibrous composition | Mixture of ⅗ Cenibra and of ⅖ Sodra Black R<br>Refining: 45°SR<br>Concentration 22.5 g/L | Mixture of ⅗ Cenibra and of ⅖ Sodra Black R<br>Refining: 45°SR<br>Concentration 22.5 g/L | |
| % of pulp used | 100% | 50% | 50% |
| Addition 1: cationic starch (binder) | Amylofax PW-A (DS 0.035)<br>3% dry/fibres<br>Stirring: 50 min | Amylofax PW-A (DS 0.035)<br>3% dry/fibres<br>Stirring: 50 min | |
| Addition 2: calcium carbonate (filler) | Calprec PA<br>10% dry/fibres<br>Stirring: 10 min | Calprec PA<br>10% dry/fibres<br>Stirring: 10 min | |
| Addition 3: AKD (bonding agent) | Aquapel J 215<br>0.15% dry/fibres<br>Stirring: 2 min | Aquapel J 215<br>0.15% dry/fibres<br>Stirring: 2 min | |
| Addition 4: cationic surfactant | None<br>—<br>— | | CTAB<br>5% dry/fibres<br>Stirring: 2.5 min |

TABLE 12-continued

| Description of the manufacture of sheet formers | | |
|---|---|---|
| Sheet former | Control (without surfactants) | CTAB:AOT in a ratio 1:1 w/w |
| Addition 5: anionic surfactant | None<br>—<br>— | AOT<br>5% dry/fibres<br>Stirring: 2.5 min |
| Transfer into the bowl of the sheet former | Dilution | All of the pulp is put into the presence in the bowl of the sheet former and diluted. |
| Addition 6: polyamine (retention agent) | Retaminol K<br>0.05% dry/fibres | Retaminol K<br>0.05% dry/fibres |
| Forming | Agitation<br>Draining (1 min 30)<br>Pressing (1 min)<br>Drying in temperature at 100° C.-10 min | Agitation<br>Draining (1 min 30)<br>Pressing (1 min)<br>Drying in temperature at 100° C.-10 min |

b) Characterization of the Properties of the Paper

The physical properties of the paper produced as such were evaluated. Various characteristic measurements were taken, such as the tensile strength, tearing strength or bursting strength. An evaluation of the printability through measurement of IGT tearing was also conducted. The various results are shown in the table hereinbelow.

TABLE 13

| Physical properties of the sheet formers produced. | | | |
|---|---|---|---|
| Sheet former | | Control | CTAB:AOT (1:1) |
| % of additive of the surfactant type introduced | | 0% | 10% dry/fibres |
| Paper weight (g/m$^2$) | | 114 | 110 |
| Burst (kPa) | | 504 | 222 |
| Burst index (kPa · m$^2$/g) | | 4.42 | 2.02 |
| Tear (mN) | | 1096 | 546 |
| Tear index (mN · m$^2$/g) | | 9.61 | 2.46 |
| Bendtsen porosity (mL/min) | | 100 | 311 |
| Internal cohesion (Scott unit) | | 210 | 131 |
| Traction Force (N) | | 111.4 | 54.7 |
| Elongation (%) | | 3.6 | 1.9 |
| Breaking length (km) | | 6.6 | 3.4 |
| Cobb (mL/min) | | 28 | 261 |
| Dry pulling off IGT (pressure 35 kgf - increasing speed 0 to 7 m/s - ink 3804) | Thumb wheel | No pulling off point | Strong pulling off |
| | Strip | Strong linting | Front 4.44 m<br>Back 4.13 m |

These measurements, compared to those listed in table 6 and in table 9 for paper according to the invention, show superior mechanical properties of the paper according to the invention as well as superior printability and the adequacy of its ability to absorb water.

c) Coloration of the Sheet Formers

The paper produced as such is colored by the method of dyeing described in example 1 paragraph e.

Measurements by spectrophotometry were taken on these sheets. As such, an intense level of color is obtained and the values of K/S measured are shown in the table hereinbelow.

TABLE 14

| Value of K/S obtained on sheet formers into which were introduced 10% (in dry weight/dry weight of fibres) of a mixture of CTAB/AOT in a ratio 1:1 and coloured by impregnation with supercritical $CO_2$. | | |
|---|---|---|
| Additive | % introduced | K/S |
| CTAB:AOT (1:1) | 10% | 7.3 |

d) Characterization of the Bleeding

Bleeding tests were conducted according to the protocol described in example 1, paragraph f. In this case, substantial bleeding is already observed after 1 hour on the non-colored glass fiber papers.

COMPARATIVE EXAMPLE 6: CHARACTERIZATION OF THE BLEEDING OF AN INTENSE BLUE COMMERCIAL PAPER

Bleeding tests were conducted according to the protocol described in example 1, paragraph f. In the case of an intense blue commercial paper whose color is obtained by a standard paper-making method, substantial bleeding is already observed after 1 hour on the non-colored glass fiber papers.

REFERENCES

1] "Soluble anionic trisazo dyes of aromatic series—for natural and synthetic fibres, esp. leather". Brevet BE-834146, 1976.

2] "Halogen-contg. isoindoline pigments—useful for colouring plastics, paint, etc. in yellow shades". Brevet DE2805234, 1978.

3] "Anthraquinone pigments—and vat dyes, for cellulose fibres, paints, printing inks and plastics". Brevet DE2123963, 1972.

4] "Disazo dispersion pigment dyes—for synthetic fibres paints, printing inks, and plastics". Brevet DE2138014, 1973.

5] "Azo dyes having one or two triazinyl- or pyrimidyl-acetic acid ester or amide coupling component radicals". Brevet BE-820674, 1973.

6] "Blue cationic oxazine dye contg. tert. and prim. amino—for dyeing or printing paper leather and polyacrylonitrile etc". Brevet IT7949811, 1978.

7] "Azo anthraquinone pigments". Brevet CH-635218, 1976.

8] "Monazo dyes free of sulphonic acid groups". Brevet BE-740009, 1968.

9] "Reactive polymeric monochlorotriazine dyes". Brevet GB-923429, 1958.

10] "Dyes substd. by imidazolyl-methyl gps. —esp. for colouring paper". Brevet DE3044563, 1980.

11] "Dyeing paper with 2, 1-benzoisothiazole sulphonic acid azo dyestuff—giving brilliant light-fast dyeing". Brevet DE3041838, 1980.

12] "Fixation of dyes on colored paper". U.S. Pat. No. 1,926,614, 1931.

13] "Dip dyeing type paper dyeing method". Brevet CN102877363, 2012.

14] "Colorant composition and method of coloring". Brevet WO2006112452, 2006.

15] K. Blus, J. Czechowski and A. Kozirog, "New Eco-friendly Method for Paper Dyeing," *Fibres & Textiles in Eastern Europe*, pp. 121-125, 5 (107) 22, 2014.

16] "Supercritical CO2". Brevet EP 2 876 203, 2013.

17] "Method for colouring cellulose". Brevet WO/2015/140750, 2015.

18] "Imprégnation d'un papier à l'aide d'un fluide supercritique". Brevet FR3015988, 2015.

19] "Latex containing papers". U.S. Pat. No. 4,510,019, 1985.

20] "Paper sheet having a very high proportion of latex, process for preparing same and applications thereof particularly as a substitution product for impregnated glass webs". U.S.

21] "Latex-saturated paper". Brevet CA 02211776, 1997.

22] "Feuille de papier transparente or translucide, son method de fabrication and emballage le containing". Brevet FR2916769, 2008.

23] "Method of making paper". Brevet WO 2011/146367 A1, 2011.

24] "Support plan hydrophobe". Brevet WO 2014/177586 A1, 2014.

The invention claimed is:

1. Method for impregnating a dry paper and in particular dyeing, by means of a supercritical-pressure fluid being a fluid in the supercritical or subcritical state, comprising a step of impregnation by putting paper into contact with molecules of interest in the presence of the fluid in the supercritical or subcritical state, said paper comprising, (i) at the core, a polymeric additive introduced in the form of latex and/or (ii) on the surface, a polymeric additive applied in the form of latex, identical or different from the polymeric additive possibly present at the core, wherein the molecules of interest are chosen from dye molecules, reactive disperse dyes, optical brightening agents, fluorophores, antioxidants, molecules that absorb ultraviolet rays, surfactants, polymers and paraffinic waxes, wherein the dye molecules are formed by a dispersed hydrophobic dye or a mixture of dispersed hydrophobic dyes, the dye or dyes being added at a level of from 0.1 to 10% by dry weight of dye or dyes relative to the weight of the paper, said method comprising the steps of:

a) loading into a reactor, dry paper to be impregnated with the molecules of interest, and a determined quantity of the molecules of interest, followed by the closure of the reactor, b) loading a fluid, at the storage pressure of the fluid, c) heating the reactor and/or pumping the fluid until obtaining the conditions of pressure and temperature that allow the solubilization of the molecules of interest, in the fluid in the supercritical or subcritical state, and impregnating of the molecules of interest, in the thickness of the paper, d) circulating the supercritical-pressure fluid loaded with the molecules of interest, through the paper, e) sweeping with the clean supercritical-pressure fluid under conditions of temperature and pressure that are supercritical or subcritical, identical or different from those of the step c in order to eliminate non-fixed molecules of interest, f) depressurizing the reactor to precipitate the remaining dye or dyes and allowing the fluid in the supercritical or subcritical state to return to the gaseous state, and g) recovering the dry paper, colored at the core and/or on the surface.

2. Method according to claim 1, wherein the supercritical-pressure fluid is carbon dioxide in the supercritical or subcritical state or a mixture of carbon dioxide with an organic solvent.

3. Method according to claim 2, wherein the organic solvent is an alcohol.

4. Method according to claim 1, wherein the supercritical-pressure fluid is carbon dioxide and the temperature during the supercritical-pressure impregnation phase is greater than or equal to the ambient temperature and in particular less than or equal to 200° C., and the pressure during the supercritical-pressure impregnation phase is greater than or equal to 75 bars and less than 1000 bars.

5. Method according to claim 1, wherein the paper is obtained from a paper pulp comprising:

i) a fibrous suspension based on cellulose fibers in water having a concentration of cellulose fibers from 2 to 50 g/l, said suspension being refined to a degree of at least 17° SR;

ii) a polymeric additive in the form of latex, said latex being added to the fibrous suspension in a proportion from 0.5 to 50% by weight of dry product, relative to the dry weight of the cellulose fibers.

6. Method according to claim 5, wherein the paper pulp comprises a retention agent formed by a cationic compound capable of fixing the latex on the cellulosic fibers.

7. Method for preparing according to claim 6, wherein the cationic compound is chosen from cationic flocculation agents, cationic resins capable of reacting with the cellulosic fibers, crosslinkable resins on the cellulosic fibers, and cationic starch.

8. Method according to claim 7, wherein the cationic resin is a polyamide-amine-epichlorohydrine resin.

9. Method according to claim 5, wherein a retention agent is added to the latex in conditions enabling the retention of the latex in a fibrous mat comprising cellulose fibers, by forming ionic bonds with said fibers, said conditions comprising for example the addition of a retention agent according to a retention agent/latex ratio expressed as a percentage of dry retention agent/dry weight of latex from 0.1% to 20%.

10. Method according to claim 5, wherein cellulose fibers are a mixture of fibers of different lengths chosen from short fibers of length in the range from 0.1 to 0.49 mm, medium fibers of length in the range from 0.5 to 1.5 mm and long fibers of length in the range from 1.6 to 3 mm.

11. Method according to claim 5, wherein a proportion of cellulosic fibers of a first determined length is from 40 to 50% and a proportion of cellulosic fibers of a second determined length is from 60 to 50%.

12. Method according to claim 5, wherein the formulation of the pulp is adjusted by adding fillers, pigments, bonding agent, dry resistance agent, wet resistance agent, fluorescent agent, fire-proofing agent, liquid barrier or gas barrier product.

13. Method according to claim 1, wherein the paper is obtained:

i) from a paper pulp comprising a fibrous suspension based on cellulose fibers in water having a concentration of cellulose fibers from 2 to 50 g/l, said suspension being refined to a degree of at least 17° SR, and a polymeric additive in the form of latex, said latex being added to the fibrous suspension in a proportion from 0.5 to 50% by weight of dry product, in particular from 0.5 to 20% by weight of dry product, relative to the dry weight of the cellulose fibers and ii) according to a method of manufacturing paper comprising a step of depositing on the surface of the paper, a polymeric additive in the form of latex in a proportion from 0.5 to 25% by weight relative to the weight of the paper.

14. Method according to claim 1, wherein the latex is an aqueous ionic dispersion of particles of copolymer, said copolymer having a glass transition temperature less than 100° C.

15. Method according to claim 1, wherein the latex is obtained from a copolymer, at least one of the monomers of which is chosen from ether monomers, vinyl monomers, styrene monomers, acrylic monomers, methacrylic monomers, urethane and dienic monomers.

16. Method according to claim 15, wherein the latex is obtained from a copolymer chosen from the group of styrene-butadiene copolymers, styrene-acrylic copolymers, acrylic ester-acrylonitrile copolymers, vinyl acetate-ethylene copolymers, ether-urethane copolymers, and vinyl chloride-vinyl acetate-ethylene copolymers.

17. Method according to claim 15, wherein the latex is obtained from a copolymer chosen from the group of copolymers of styrene and acrylate, copolymers of acrylic ester and acrylonitrile, copolymers of acrylate and vinyl acetate, copolymers of styrene butadiene, copolymers of ethylene and vinyl acetate, polyacrylate, ether-urethane copolymers, copolymers of acrylic ester, styrene and acrylonitrile, polyurethane, copolymers of vinyl chloride and ethylene.

18. Method according to claim 15, wherein the latex is obtained from a copolymer chosen from the group of copolymers of styrene and acrylate, copolymers of acrylic ester and acrylonitrile, copolymers of acrylate and vinyl acetate copolymers, copolymers of styrene butadiene, copolymers of ethylene and vinyl acetate.

19. Method according to claim 1, wherein the molecules of interest are dye molecules.

20. Method according to claim 1, wherein the latex is an aqueous ionic dispersion of particles of a crosslinked or crosslinkable polymer whose chains comprise Lewis base groups.

21. Method according to claim 20, wherein the Lewis base groups are selected from ethers, carbonyl, carboxyl or phenyl groups or mixtures thereof.

22. Method for manufacturing impregnated paper by means of a supercritical-pressure fluid, comprising the following steps:

a. preparing in a pulper a paper pulp comprising:
   (i) fibrous suspension based on cellulose fibers in water having a concentration of cellulose fibers from 2 to 50 g/l, said suspension being refined to a degree of at least 17° SR;
   (ii) a polymeric additive in the form of latex, said latex being added to the fibrous suspension in a proportion from 0.5 to 50% by weight of dry product, relative to the dry weight of the cellulose fibers, b. adjusting the prepared pulp and/or diluting to the desired concentration, before it is sent into the headbox for the purpose of homogeneous distribution, c. draining the pulp distributed beforehand over the wire cloth of the paper machine, the drainage being carried out via gravity and by suction using suction boxes, to produce a sheet of paper, d. dewatering the sheet obtained in the step c and drying to obtain a sheet with the moisture content less than or equal to 7%, e. impregnating, the sheet obtained by implementing the method for impregnating according to claim 1.

23. Method according to claim 22, wherein the manufactured paper is colored paper.

* * * * *